US009950521B2

(12) United States Patent
Nitta et al.

(10) Patent No.: US 9,950,521 B2
(45) Date of Patent: Apr. 24, 2018

(54) INKJET HEAD AND INKJET PRINTER

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Noboru Nitta, Shizuoka (JP); Yasuhito Komai, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/609,231

(22) Filed: May 31, 2017

(65) Prior Publication Data

US 2017/0259564 A1 Sep. 14, 2017

Related U.S. Application Data

(63) Continuation of application No. 15/202,699, filed on Jul. 6, 2016, now Pat. No. 9,694,577.

(30) Foreign Application Priority Data

Jul. 6, 2015 (JP) ..... 2015-135243
Apr. 21, 2016 (JP) ..... 2016-085470

(51) Int. Cl.
*B41J 2/045* (2006.01)

(52) U.S. Cl.
CPC ..... *B41J 2/04588* (2013.01); *B41J 2/04541* (2013.01); *B41J 2/04581* (2013.01);
(Continued)

(58) Field of Classification Search
CPC ..... B41J 2/04581; B41J 2/04588; B41J 2/04595; B41J 2/04596; B41J 2/17563;
(Continued)

(56) References Cited

U.S. PATENT DOCUMENTS 6,793,311 B2 9/2004 Baba et al.
7,407,246 B2 8/2008 Vanhooydonck
(Continued)

FOREIGN PATENT DOCUMENTS

JP 2002-137390 5/2002
JP 2012-066489 4/2012
(Continued)

*Primary Examiner* — Thinh H Nguyen
(74) *Attorney, Agent, or Firm* — Amin, Turocy & Watson LLP

(57) ABSTRACT

In accordance with an embodiment, an inkjet head comprises a pressure chamber configured to house ink; an actuator configured to be arranged corresponding to the pressure chamber; a plate configured to have a nozzle communicating with the pressure chamber; and a driving circuit configured to drive the actuator, wherein the drive circuit applies an auxiliary pulse signal which contains an expansion pulse for expanding the volume of the pressure chamber and a contraction pulse for contracting the volume of the pressure chamber in such a degree as not to eject an ink drop from the nozzle to the actuator before enabling the ink drop to be ejected from the nozzle communicating with the pressure chamber by applying the expansion pulse and the contraction pulse as a drive pulse signals.

14 Claims, 16 Drawing Sheets

(52) U.S. Cl.
CPC ..... *B41J 2/04595* (2013.01); *B41J 2/04596* (2013.01); *B41J 2202/10* (2013.01)

(58) Field of Classification Search
CPC .... B41J 2/0451; B41J 2/1752; B41J 2/04541; B41J 2002/10
See application file for complete search history.

(56) References Cited

U.S. PATENT DOCUMENTS

| | | | | |
|---|---|---|---|---|
| 7,452,045 | B2 | 11/2008 | Suzuki | |
| 7,857,406 | B2 | 12/2010 | Komai | |
| 8,845,052 | B2 | 9/2014 | Tamura et al. | |
| 9,079,393 | B2 | 7/2015 | Hiyoshi et al. | |
| 2010/0118073 | A1* | 5/2010 | Kitami | B41J 2/04543 347/10 |
| 2011/0134176 | A1* | 6/2011 | Matsuo | B41J 2/04573 347/10 |
| 2015/0116400 | A1* | 4/2015 | Sasaki | B41J 2/04588 347/10 |
| 2016/0082722 | A1 | 3/2016 | Nitta et al. | |

FOREIGN PATENT DOCUMENTS

| | | |
|---|---|---|
| JP | 2012-135900 | 7/2012 |
| JP | 2015-089645 | 5/2015 |

* cited by examiner

INKJET HEAD AND INKJET PRINTER

CROSS-REFERENCE TO RELATED APPLICATIONS

This application is a Continuation of application Ser. No. 15/202,699 filed Jul. 6, 2016, the entire contents of which are incorporated herein by reference.

The present application is based upon and claims the benefit of priorities from Japanese Patent Application No. 2015-135243 filed on Jul. 6, 2015 and Japanese Patent Application No. 2016-085470 filed on Apr. 21, 2016, the entire contents of which are hereby incorporated by reference.

FIELD

Embodiments described herein relate generally to an inkjet head and an inkjet printer with the inkjet head.

BACKGROUND

There is a type of inkjet head which takes a partition wall of two adjacent pressure chambers as an actuator. In such a type of inkjet head, when a driving pulse signal including an expansion pulse and a contraction pulse is applied to the actuator, the partition wall deforms in a direction in which the pressure chamber is expanded or in a direction in which the pressure chamber is contracted. Then, pressure vibration is generated in the pressure chamber due to the volume change, and ink drops are ejected from a nozzle communicating with the pressure chamber.

In this way, since the inkjet head enables the ink drops to be ejected from the nozzle by deforming the partition wall of the pressure chambers, it is not possible to simultaneously eject the ink drops from adjacent nozzles which communicate with the adjacent pressure chambers respectively. Thus, the inkjet head divides the pressure chambers into, for example, three groups every third pressure chamber, and changes the phase of the driving pulse signal for each group. According to image patterns, three states are generated, which includes: one state where one nozzle ejects ink and the other nozzles do not eject ink (hereinafter, referred to as a single-nozzle driving state), one state where nozzles ejecting ink belong to any group and ink is not ejected from nozzles belonging to other groups (hereinafter, referred to as a multi-nozzle simultaneous driving state), and one state where ink is ejected from nozzles belonging to at least two groups at time division (hereinafter, referred to as a continuous multi-nozzle driving state).

The inkjet head adopts a multi-drop method adjusting the number of the ink drops ejected from one nozzle in case of carrying out gradation printing. In a case of adopting the multi-drop method, the ejection speed of the ink drops after the second drop is fastened due to the residual pressure vibration of the ink drop just ejected. However, since the pressure vibration is applied in a state where a meniscus is still, the ejection speed of the first drop of the ink drops is slower than that of the ink drops following the second drop. There is a technology to increase the ejection speed of the first drop by applying an auxiliary pulse signal (boost pulse) for amplifying the pressure vibration of the pressure chamber before the driving pulse signal for enabling the first drop to be ejected.

In a case of the multi-nozzle simultaneous driving state, there is a disadvantage that the ejection speed of the second drop is slower than that of the first drop, and thus the second drop is separated from the first drop and impacts on the first drop.

DETAILED DESCRIPTION

In accordance with an embodiment, an inkjet head comprises a pressure chamber configured to house ink, an actuator configured to be arranged corresponding to the pressure chamber, a plate configured to have a nozzle communicating with the pressure chamber, and a driving circuit configured to drive the actuator. The drive circuit applies an auxiliary pulse signal which contains an expansion pulse for expanding the volume of the pressure chamber and a contraction pulse for contracting the volume of the pressure chamber in such a degree as not to eject an ink drop from the nozzle to the actuator before enabling one ink drop and even continuous multiple ink drops to be ejected from the nozzle communicating with the pressure chamber by applying a drive waveform which contains the expansion pulse and the contraction pulse as a drive pulse signal once or for multiple times to the actuator, in this way, the ejection speed in a case of ejecting first one ink drop is almost equal to that of the second drop in a case of continuously ejecting two ink drops.

Hereinafter, the inkjet head and an inkjet printer using the inkjet head according to the embodiment are described with reference to the accompanying drawings. In the embodiment, a share mode/shared wall type inkjet head 100 (refer to FIG. 1) is exemplified as the inkjet head.

Figure 1:
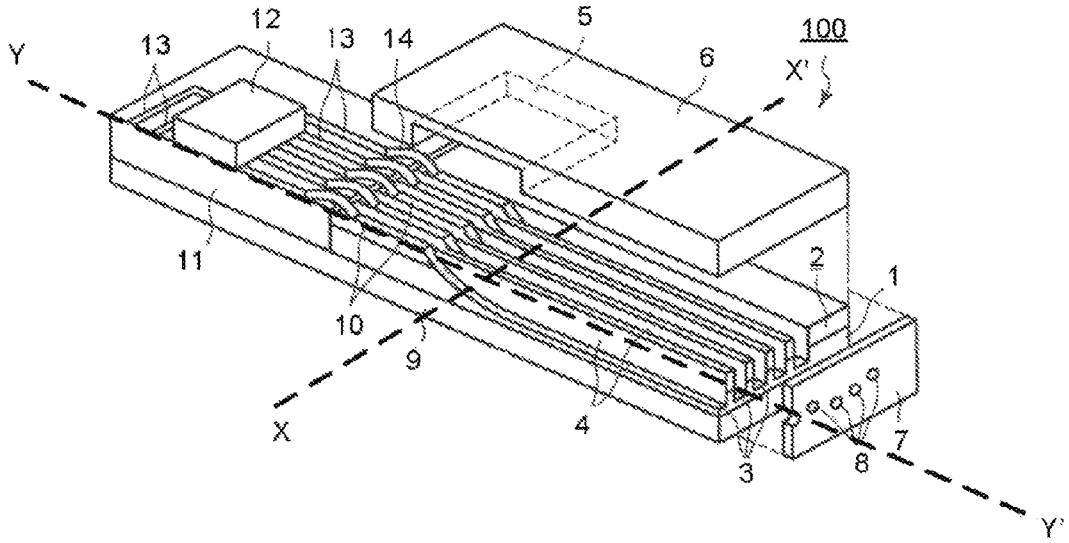
FIG. 1 is an exploded perspective view illustrating a part of an inkjet head.
Figure 2:
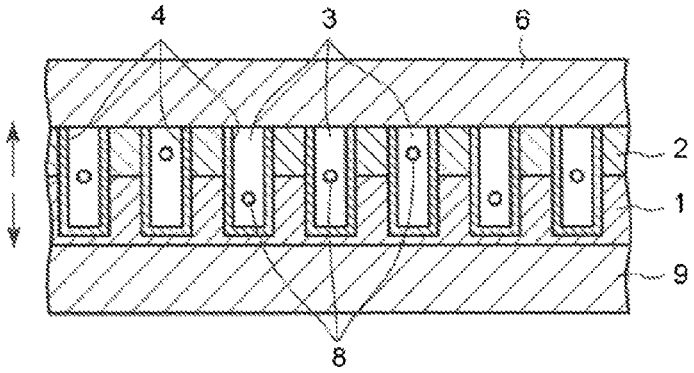
FIG. 2 is a section view illustrating a front part of the inkjet head taken along a line X-X'.
Figure 3:
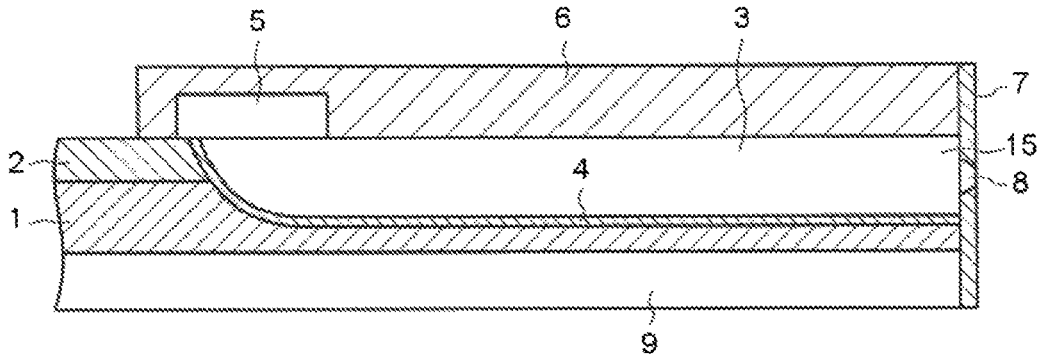
FIG. 3 is a section view illustrating the front part of the inkjet head taken along a line Y-Y'.

First, the constitution of the inkjet head 100 (hereinafter, referred to as a head 100 for short) is described with reference to FIG. 1~FIG. 3. FIG. 1 is an exploded perspective view illustrating a part of the head 100, FIG. 2 is a section view illustrating the front part of the head 100 taken along a line X-X', and FIG. 3 is a section view illustrating the front part of the head 100 taken along a line Y-Y'.

The head 100 is equipped with a base substrate 9. The head 100 bonds a first piezoelectric member 1 to the upper surface at the upper side of the base substrate 9 and bonds a second piezoelectric member 2 on the first piezoelectric member 1. The bonded first piezoelectric member 1 and second piezoelectric member 2 are polarized in the mutually opposite directions along the thickness direction of the base substrate 9 as shown by arrows of FIG. 2.

The base substrate 9 is made from a material which has a small dielectric constant and of which the difference in thermal expansion coefficient from the piezoelectric members 1 and 2 is small. As a material of the base substrate 9, for example, alumina ($Al_2O_3$), silicon nitride ($Si_3N_4$), silicon carbide (SiC), aluminum nitride (AlN) and lead zirconic titanate (PZT) are preferable. On the other hand, as a material of the piezoelectric members 1 and 2, lead zirconic titanate (PZT), lithium niobate ($LiNbO_3$) and lithium tantalate ($LiTaO_3$) are used.

The head 100 arranges a plurality of long grooves 3 from the front end side towards the rear end side of the bonded piezoelectric members 1 and 2. The grooves 3 are arranged with a given interval successively therebetween in parallel with each other. The front end of each groove 3 is opened and the rear end thereof is inclined upwards.

The head 100 arranges an electrode 4 on side walls and the bottom of each groove 3. The electrode 4 has a two-layer structure consisting of thin gold (Au) over nickel (Ni). The electrode 4 is formed uniformly in each groove 3 with a plating method. The forming method of the electrode 4 is not limited to the plating method. In addition, a sputtering method or an evaporation method may also be used.

The head 100 arranges an extraction electrode 10 from the rear end of each groove 3 towards the upper surface of the rear side of the second piezoelectric member 2. The extraction electrode 10 extends from the electrode 4.

The head 100 includes a top plate 6 and an orifice plate 7. The top plate 6 seals the upper part of each groove 3. The orifice plate 7 seals the front end of each groove 3. In the head 100, a plurality of pressure chambers 15 is formed with the grooves 3 each of which is surrounded by the top plate 6 and the orifice plate 7. The pressure chambers 15, for example, each of which has a depth of 300 μm and a width of 80 μm, are arranged in parallel at an interval of 169 μm. Such a pressure chamber 15 is referred to as an ink chamber.

The top plate 6 comprises a common ink chamber 5 at the rear of the inside thereof. The orifice plate 7 arranges a nozzle 8 at a position opposite to each groove 3. The nozzles 8 are connected with the grooves 3, in other words, the pressure chambers 15 facing the nozzles 8. The nozzle 8 is formed into a taper shape from the pressure chamber 15 side towards the ink ejection side of the opposite side to the pressure chamber 15 side. Three nozzles 8 corresponding to the adjacent three pressure chambers 15 are assumed as a set and are formed in a shifted manner at a given interval in the height direction (vertical direction of paper surface of FIG. 2) of the groove 3.

The head 100 bonds a printed substrate 11 on which conductive patterns 13 are formed to the upper surface at the rear side of the base substrate 9. The head 100 carries a drive IC 12 in which a head drive circuit 101 described later is mounted on the printed substrate 11. The drive IC 12 is connected with the conductive patterns 13. The conductive patterns 13 are bonded with each extraction electrode 10 via conducting wires 14 through a wire bonding.

A set consisting of a pressure chamber 15, an electrode 4 and a nozzle 8 included in the head 100 is referred to as a channel. That is, the head 100 includes channels ch.1, ch.2, . . . , ch.N, wherein the number of channels is N corresponding to the number of the grooves 3.

Next, an operation principle of the head 100 with a structure as described above is described with reference to FIG. 4A and FIG. 4B.

Figure 4A:
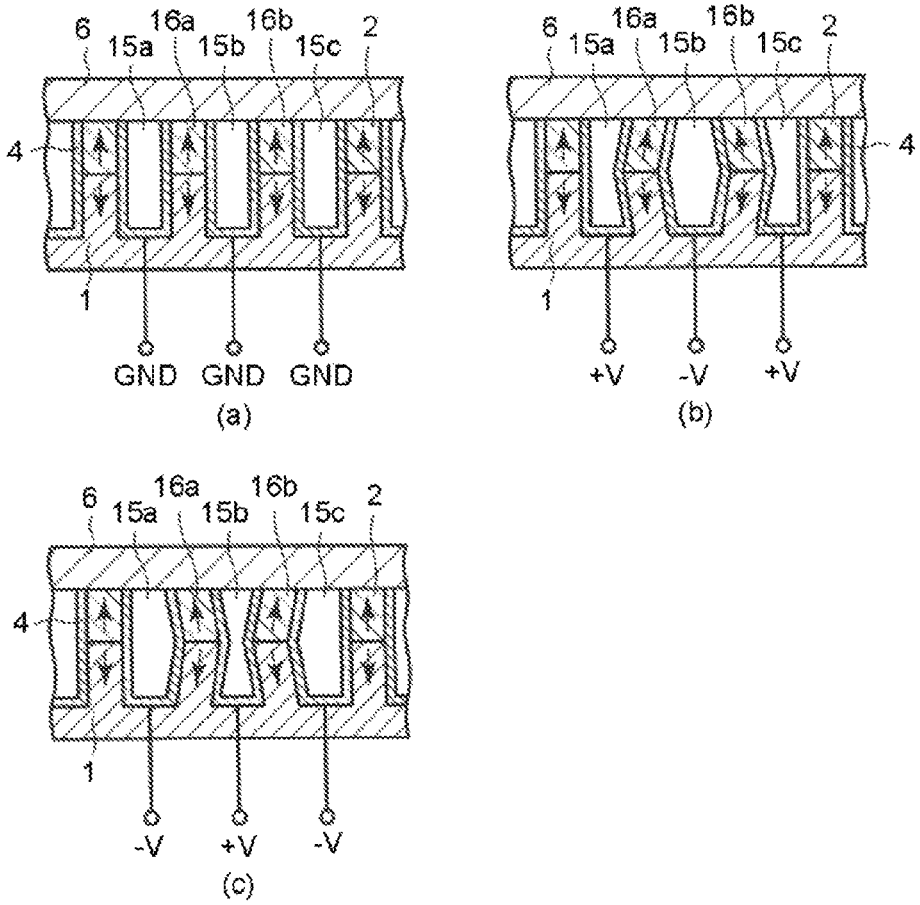
FIG. 4A is a diagram illustrating an operation principle of the inkjet head.

FIG. 4A(a) illustrates a state where the potential of each electrode 4 which is arranged on each wall surface of a pressure chamber 15*b* at the center and pressure chambers 15*a* and 15*c* adjacent to both sides of the pressure chamber 15*b* is ground potential GND. In such a state, no distortion effect acts on both a partition wall 16*a* sandwiched by the pressure chamber 15*a* and the pressure chamber 15*b* which are adjacent to each other and a partition wall 16*b* sandwiched by the pressure chamber 15*b* and the pressure chamber 15*c* which are also adjacent to each other.

FIG. 4A(b) illustrates a state where the electrode 4 of the central pressure chamber 15*b* is applied with a voltage of −V having a negative polarity and the electrodes 4 of the pressure chambers 15*a* and 15*c* adjacent to both sides of the pressure chamber 15*b* are applied with a voltage of +V having a positive polarity. In such a state, an electric field which is twice as large as that of the voltage of V acts on the partition walls 16*a* and 16*b* in a direction orthogonal to the polarized direction of the piezoelectric members 1 and 2. Through such an action, each of the partition walls 16*a* and 16*b* is deformed towards outside such that the volume of the pressure chamber 15*b* is expanded.

FIG. 4A(c) illustrates a state where the electrode 4 of the central pressure chamber 15*b* is applied with a voltage of +V having the positive polarity and the electrodes 4 of the pressure chambers 15*a* and 15*c* adjacent to both sides of the pressure chamber 15*b* are applied with a voltage of −V having the negative polarity. In such a state, the electric field which is twice as large as that of the voltage of V acts on the partition walls 16*a* and 16*b* in a direction reverse to that shown in FIG. 4(*b*). Through such an action, each of the partition walls 16*a* and 16*b* is deformed towards inside such that the volume of the pressure chamber 15*b* is contracted.

In a case in which the volume of the pressure chamber 15*b* is expanded or contracted, pressure vibration occurs in the pressure chamber 15*b*. Through the pressure vibration, the pressure in the pressure chamber 15*b* is increased, and an ink drop is ejected from the nozzle 8 communicating with the pressure chamber 15*b*.

In this way, the partition wall 16*a* which separates the pressure chambers 15*a* and 15*b* and the partition wall 16*b* which separate the pressure chambers 15*b* and 15*c* are actuators for applying the pressure vibration to the inside of the pressure chamber 15*b* which takes the partition walls 16*a* and 16*b* as inside walls. That is, each pressure chamber 15 shares the actuators with adjacent pressure chambers 15 respectively. Thus, the head drive circuit 101 cannot individually drive each pressure chamber 15. The head drive circuit 101 drives the pressure chamber 15 in a manner of segmenting the pressure chambers 15 into (n+1) (n is an integer which is equal to or greater than 2) groups every (n+1)th pressure chamber. In the present embodiment, a case in which the head drive circuit 101 carries out division driving in such a manner that the pressure chambers 15 are divided into three groups every third pressure chamber, that is, three division driving is carried out. Further, three division driving is only an example, and four division driving or five division driving may also be applicable.

However, in FIG. 4A (a), (b) and (c), in order to eject the ink from the nozzle corresponding to the central pressure chamber 15*b*, the voltages +V and −V having reverse polarities to each other are applied to the electrode 4 of the central pressure chamber 15*b* and the electrodes 4 of the pressure chambers 15*a* and 15*c* adjacent to both sides of the pressure chamber 15*b*. That is, the electric field having a value obtained by dividing double voltages V by the thickness of the actuator acts on the actuator. The example of ejecting the ink from the nozzle corresponding to the central pressure chamber 15*b* is not limited to this.

Figure 4B:
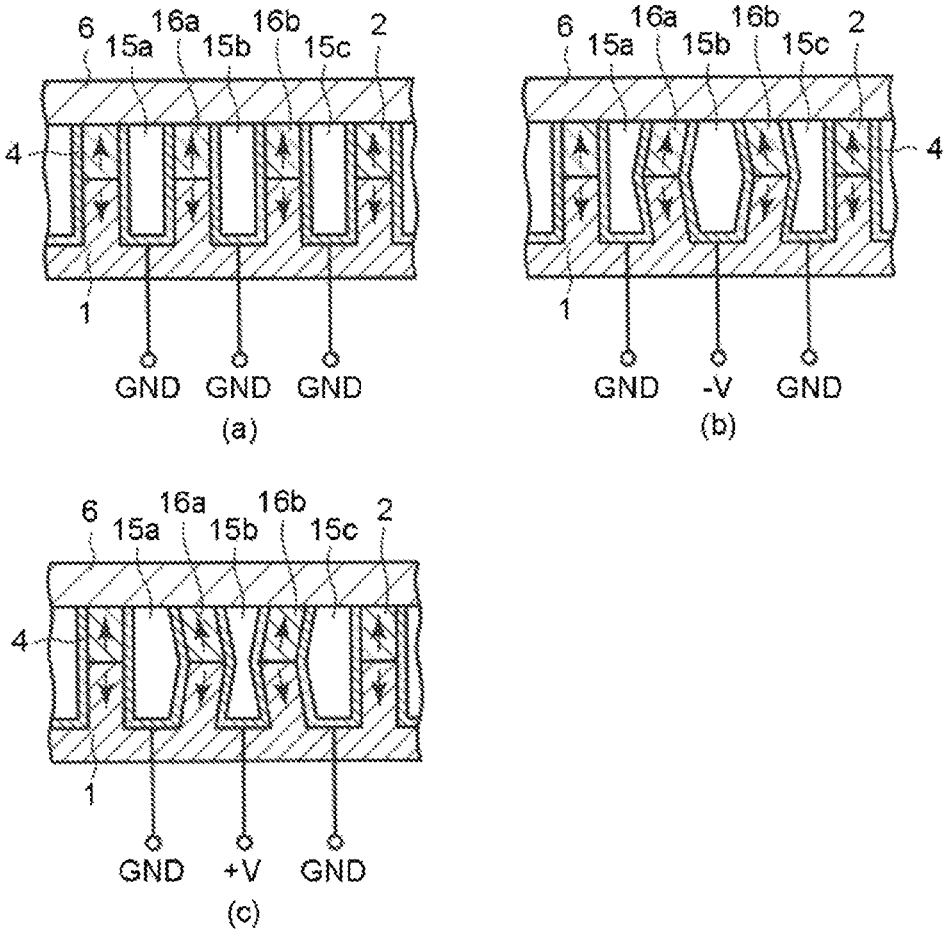
FIG. 4B is a diagram illustrating an operation principle of the inkjet head.

In FIG. 4B (a), (b) and (c), the electrodes 4 of the pressure chambers 15*a* and 15*c* adjacent to both sides of the pressure chamber 15*b* are set to the ground potential GND, and voltages −V and +V are only applied to the electrode 4 of the central pressure chamber 15*b*. That is, the electric field having a value obtained by dividing the voltage V by the thickness of the actuator acts on the actuator. In this case, if the applied voltage V is set to double voltages, the operations of the actuator are completely identical to those in the case of FIG. 4A. Since the description of FIG. 4B is simple, the following description is described mainly with reference to FIG. 4B.

Figure 5:
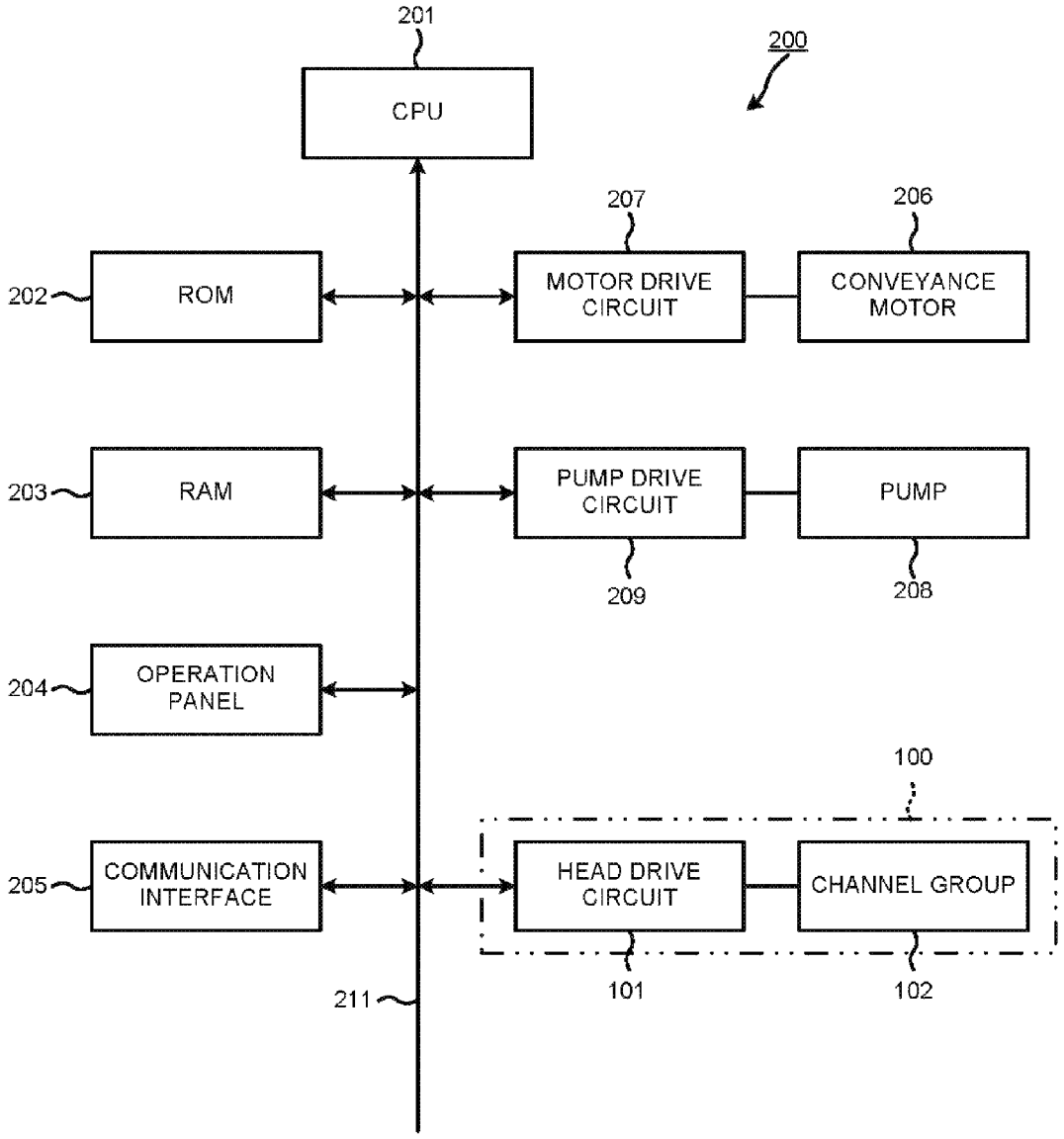
FIG. 5 is a block diagram illustrating the hardware constitution of the inkjet printer.
Figure 6:
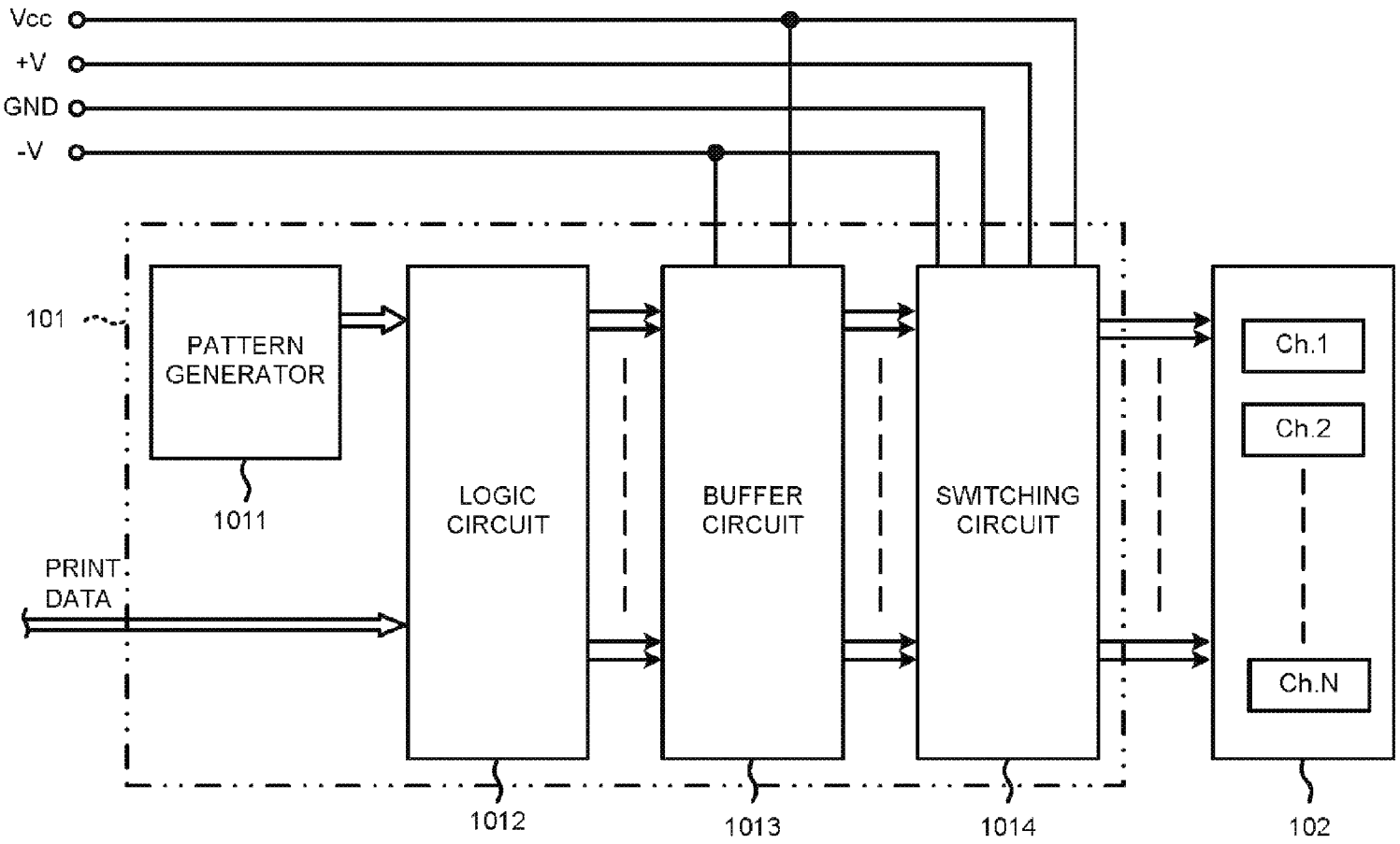
FIG. 6 is a block diagram illustrating the concrete constitution of a head driving circuit in the inkjet printer.
Figure 7:
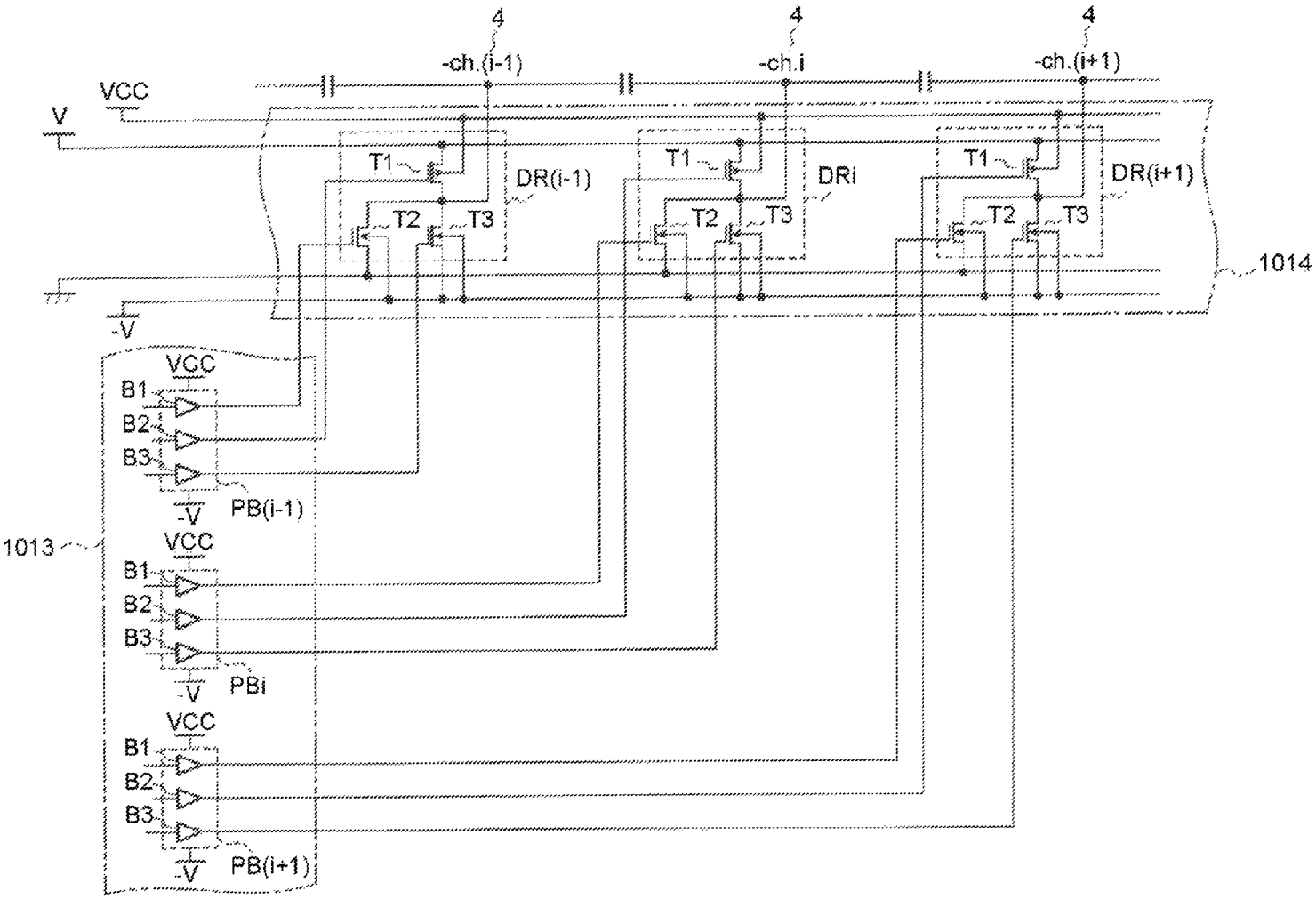
FIG. 7 is a schematic circuit diagram illustrating a buffer circuit and a switch circuit contained in the head driving circuit.

Next, the structure of an inkjet printer 200 (Hereinafter, abbreviated to a printer 200) is described with reference to FIG. 5-FIG. 7. FIG. 5 is a block diagram illustrating the hardware structure of the printer 200, FIG. 6 is a block diagram illustrating the concrete structure of the head drive circuit 101, and FIG. 7 is a schematic circuit diagram illustrating a buffer circuit 1013 and a switching circuit 1014 contained in the head drive circuit 101. The printer 200 may be a printer for office, a barcode printer, a printer for POS or a printer for industry.

The printer 200 comprises a CPU (Central Processing Unit) 201, a ROM (Read Only Memory) 202, a RAM (Random Access Memory) 203, an operation panel 204, a communication interface 205, a conveyance motor 206, a motor drive circuit 207, a pump 208, a pump drive circuit 209 and the head 100. The printer 200 further comprises a bus line 211 such as an address bus line, a data bus line and the like. The printer 200 connects the CPU 201, the ROM 202, the RAM 203, the operation panel 204, the communication interface 205, the motor drive circuit 207, the pump drive circuit 209 and the head drive circuit 101 of the head 100 with the bus line 211 directly or via an input/output circuit.

The CPU 201 acting as the main unit of a computer controls each section to realize various functions of the printer 200 according to an operating system or application programs.

The ROM 202 acting as the main memory unit of the foregoing computer stores the foregoing operating system or application programs. The ROM 202, in some cases, also stores data required to execute processing for controlling each section by the CPU 201.

The RAM 203 acting as the main memory unit of the foregoing computer stores data required to execute processing by the CPU 201. The RAM 203 is also used as a working area for suitably rewriting information by the CPU 201. The working area includes an image memory in which print data is copied or decompressed.

The operation panel 204 includes an operation section and a display section. The operation section includes functional keys such as a power source key, a paper feed key, an error cancellation key and the like. The display section can display various states of the printer 200.

The communication interface 205 receives print data from a client terminal that is connected with the printer 200 via a network such as an LAN (Local Area Network). For example, when an error occurs in the printer 200, the communication interface 205 sends a signal for notifying the error to the client terminal.

The motor drive circuit 207 controls to drive the conveyance motor 206. The conveyance motor 206 functions as a drive source of a conveyance mechanism which conveys an image receiving medium such as a printing paper. If the conveyance motor 206 is driven, the conveyance mechanism starts to convey the image receiving medium. The conveyance mechanism conveys the image receiving medium to a printing position where the image receiving medium is printed with the head 100. The conveyance mechanism discharges the image receiving medium the printing on which is terminated to the outside of the printer 200 via a discharging port (not shown).

The pump drive circuit 209 controls to drive the pump 208. If the pump 208 is driven, the ink in an ink tank (not shown) is supplied to the head 100.

The head drive circuit 101 drives a channel group 102 of the head 100 based on the print data. The head drive circuit 101 includes, as shown in FIG. 6, a pattern generator 1011, a logic circuit 1012, a buffer circuit 1013 and a switching circuit 1014.

The pattern generator 1011 generates waveform patterns consisting of an ejecting center waveform, an ejecting both-side waveform, a non-ejecting center waveform and a non-ejecting both-side waveform. The data of the waveform pattern generated by the pattern generator 1011 is supplied to the logic circuit 1012.

The logic circuit 1012 receives input of the print data read line by line from the image memory. If the print data is input, the logic circuit 1012 sets three adjacent channels ch.(i−1), ch.i and ch.(i+1) of the head 100 as one set and determines whether one of the channels, for example, the central channel ch.i is an ejection channel that ejects the ink or a non-ejection channel that does not eject the ink. If the channel ch.i is the ejection channel, the logic circuit 1012 outputs pattern data of the ejecting center waveform to the channel ch.i and outputs pattern data of the ejecting both-side waveforms to two adjacent channels ch.(i−1) and ch.(i+1). If the channel ch.i is the non-ejection channel, the logic circuit 1012 outputs pattern data of the non-ejecting center waveform to the channel ch.i and outputs pattern data of non-ejecting both-side waveforms to the channels ch.(i−1) and ch.(i+1) adjacent to both sides of the channel ch.i. Each pattern data output from the logic circuit 1012 is supplied to the buffer circuit 1013.

The buffer circuit 1013 is connected with a power source of a positive voltage Vcc and a power source of a negative voltage −V. The buffer circuit 1013, as shown in FIG. 7, includes pre-buffers PB1, PB2, . . . , PBN respectively for the channels ch.1, ch.2, . . . , ch.N of the head 100. Furthermore, in FIG. 7, pre-buffers PB(i−1), PBi and PB(i+1) respectively corresponding to three adjacent channels ch.(i−1), ch.i and ch.(i+1) are shown.

Each of pre-buffers PB1, PB2, . . . , PBN includes first to third buffers B1, B2 and B3, that is, three buffers. Each of the buffers B1, B2 and B3 is connected with the power source of the positive voltage Vcc and the power source of the negative voltage −V respectively.

In each of the pre-buffers PB1, PB2, . . . , PBN, the output of the first to third buffers B1, B2 and B3 varies according to signal levels of the pattern data supplied from the logic circuit 1012. The signals of different levels are supplied from the logic circuit 1012 according to whether the corresponding channel ch.k ($1 \leq k \leq N$) is an ejection channel, a non-ejection channel or a channel which is adjacent to the ejection channel or the non-ejection channel. The first to third buffers B1, B2 and B3 to which a high level signal is supplied output a signal of a positive voltage Vcc level. The first to third buffers B1, B2 and B3 to which a low level signal is supplied output a signal of a negative voltage −V level.

The output of each of the pre-buffers PB1, PB2, . . . , PBN, in other words, the output signal of the first to third buffers B1, B2 and B3 is supplied to the switching circuit 1014.

The switching circuit 1014 is connected with the power source of the positive voltage Vcc, a power source of a positive voltage +V, the power source of the negative voltage −V and the ground potential GND. The positive voltage Vcc is higher than the positive voltage +V. As a representative value, the positive voltage Vcc is 24 volt and the positive voltage +V is 15 volt. In this case, the negative voltage −V is −15 volt.

However, the proper values of the positive voltage and the negative voltage differ depending on the viscosity of the ink. The viscosity of the ink differs depending on the category of the ink and use temperature of the ink. Thus, the positive voltage +V and negative voltage −V are selected in a range of about ±15V~±30V according to the category of the ink and the use temperature of the ink. At that time, since the positive voltage Vcc has to be higher than the positive voltage +V, if the positive voltage +V is the maximum value +30 volt and the negative voltage −V is −30 volt, the positive voltage Vcc is set to 39 volt, for example.

The switching circuit 1014, as shown in FIG. 7, includes drivers DR1, DR2, . . . , DRN respectively for the channels ch.1, ch.2, . . . , ch.N of the head 100. Furthermore, in FIG. 7, drivers DR (i−1), DRi and DR (i+1) respectively corresponding to three adjacent channels ch.(i−1), ch.i and ch.(i+1) are shown.

Each of the drivers DR1, DR2, . . . , DRN includes an electric field effect transistor T1 (hereinafter, referred to as a first transistor T1) of a PMOS type and two electric field effect transistors T2 and T3 (hereinafter, referred to as a second transistor T2 and a third transistor T3) of an NMOS type. Each of the drivers DR1, DR2, . . . , DRN is connected with a series circuit constituted by the first transistor T1 and the second transistor T2 between the power source of the positive voltage +V and the ground potential GND, and further connected with the third transistor T3 between a connecting point of the first transistor T1 and the second transistor T2 and the power source of the negative voltage −V. Each of the drivers DR1, DR2, . . . , DRN connects a back gate of the first transistor T1 with the power source of the positive voltage Vcc and connects back gates of the second transistor and the third transistor with the power source of the negative voltage −V respectively. Further, each of the drivers DR1, DR2, . . . , DRN connects the first buffer B1 of each of the corresponding pre-buffers PB1, PB2, . . . , PBN with a gate of the second transistor T2, connects the second buffer B2 with a gate of the first transistor T1 and connects the third buffer B3 with a gate of the third transistor T3. Then, each of the drivers DR1, DR2, . . . , DRN applies the potential of the connecting point of the first transistor T1 and the second transistor T2 to the electrode 4 of each of the corresponding channels ch.1, ch.2, . . . , ch.N respectively.

The first transistor T1 is turned off if a signal of the positive voltage Vcc level is input from the second buffer B2, and is turned on if the signal of the negative voltage −V level is input. The second transistor T2 is turned on if the signal of the positive voltage Vcc level is input from the first buffer B1, and is turned off if the signal of the negative voltage −V level is input. The third transistor T3 is turned on if the signal of the positive voltage Vcc level is input from the third buffer B3, and is turned off if the signal of the negative voltage −V level is input.

The drivers DR1, DR2, . . . , DRN each having such a structure apply the positive voltage +V to the electrodes 4 of the corresponding channels ch.1, ch.2, . . . , ch.N if the first transistor T1 is turned on and the second transistor T2 and the third transistor T3 are turned off. The drivers DR1, DR2, . . . , DRN set the potential of the electrodes 4 of the corresponding channels ch.1, ch.2, . . . , ch.N to the ground potential GND level if the first transistor T1 and the third transistor T3 are turned off simultaneously, and the second transistor T2 is turned on. The drivers DR1, DR2, . . . , DRN apply the negative voltage −V to the electrodes 4 of the corresponding channels ch.1, ch.2, . . . , ch.N if the first transistor T1 and the second transistor T2 are turned off simultaneously, and the third transistor T3 is turned on.

Figure 8:
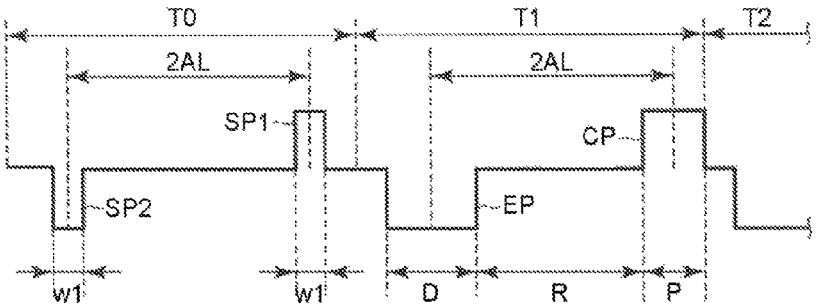
FIG. 8 is a waveform diagram illustrating a driving pulse signal in one embodiment.

FIG. 8 is a waveform diagram of the drive pulse signal that is applied to the electrode 4 of a channel (ejection channel ch.x) ejecting the ink. Such a drive pulse signal is generated according to the pattern data of the ejecting center waveform that is generated by the pattern generator 1011 of the head drive circuit 101. In FIG. 8, a section T1 indicates a pulse waveform (ejection pulse waveform) for ejecting one ink drop from the nozzle 8 of the ejection channel ch.x. The ejection pulse waveform includes an expansion pulse EP of a section D and a contraction pulse CP of a section P. A section R between the expansion pulse EP and the contraction pulse CP maintains the ground potential GND. A time interval between the center of the expansion pulse EP and the center of the contraction pulse CP is equal to a resonance period 2AL of the pressure chamber with the ink. Thus, in the case of ejecting the second drop with a multi-drop method, in a section T2 following the section T1, the ejection pulse waveform identical to that in the section T1 is repeated. In the case of ejecting an ink drop following the third drop, the following ejection pulse waveform is identical.

The expansion pulse EP sets the electrode 4 of the ejection channel ch.x to negative potential. In other words, the level of the signal output from the buffer circuit 1013 to the switch circuit 1014 changes such that the first transistor T1 and the second transistor T2 are simultaneously turned off, and the third transistor T3 is turned on for the driver DRx corresponding to the ejection channel ch.x. When the electrode 4 of the ejection channel ch.x becomes the negative potential, the pressure chamber 15 of the ejection channel ch.x is expanded.

The contraction pulse CP sets the electrode 4 of the ejection channel ch.x to positive potential. In other words, the level of the signal output from the buffer circuit 1013 to the switch circuit 1014 changes such that the first transistor T1 is turned on and the second transistor T2 and the third transistor T3 are turned off for the driver DRx corresponding to the ejection channel ch.x. When the electrode 4 of the ejection channel ch.x becomes the positive potential, the pressure chamber 15 of the ejection channel ch.x is contracted.

The electrode 4 of the ejection channel ch.x is the ground potential GND between the expansion pulse EP and the contraction pulse CP. In other words, the level of the signal output from the buffer circuit 1013 to the switch circuit 1014 changes such that the first transistor T1 and the third transistor T3 are simultaneously turned off, and the second transistor T2 is turned on for the driver DRx corresponding to the ejection channel ch.x. When the electrode 4 of the ejection channel ch.x becomes the ground potential GND, the expanded or contracted pressure chamber 15 of the ejection channel ch.x is restored.

In other words, in the section T1, the pressure chamber 15 of the ejection channel ch.x, first, expands, next, restores, then, contracts, and last, restores again. Through the change of the volume of such a pressure chamber 15, the ink drop is ejected from the nozzle 8 communicating with the pressure chamber 15. Even in the second following the section T2, similar to the section T1, by repeating expansion, restoration, contraction and restoration, the ink drop is ejected from the nozzle 8.

In the present embodiment, an output section T0 of an auxiliary pulse signal is added before the section T1 in which the first drop of the ink drops is ejected. The auxiliary pulse signal includes a first auxiliary pulse SP1 applied just before the expansion pulse EP of the first drop and a second auxiliary pulse SP2 applied before the first auxiliary pulse SP1. The space between the first auxiliary pulse SP1 and the second auxiliary pulse SP2 maintains the ground potential GND. A time interval between the center of the first auxiliary pulse SP1 and the center of the second auxiliary pulse SP2 is equal to the resonance period 2AL of the pressure chamber with the ink.

The first auxiliary pulse SP1 is a reverse polarity to the expansion pulse EP and has a pulse width w1. The second auxiliary pulse SP2 is a reverse polarity to the first auxiliary pulse SP1 and has the same pulse width w1 as the first auxiliary pulse SP1. The pulse width w1 is sufficiently short compared with the pulse width (section D) of the expansion pulse EP and the pulse width (section P) of the contraction pulse CP.

The second auxiliary pulse SP2 sets the electrode 4 of the ejection channel ch.x to the negative potential. When the electrode 4 of the ejection channel ch.x becomes the negative potential, the pressure chamber 15 of the ejection channel ch.x is expanded. In other words, the second auxiliary pulse SP2 is the expansion pulse.

The first auxiliary pulse SP1 sets the electrode 4 of the ejection channel ch.x to the positive potential. When the electrode 4 of the ejection channel ch.x becomes the positive potential, the pressure chamber 15 of the ejection channel ch.x is contracted. In other words, the first auxiliary pulse SP1 is the contraction pulse.

In this way, even in the output section T0 of the auxiliary pulse signal, similar with the section T1, the pressure chamber 15 of the ejection channel ch.x, first, expands, next, restores, then, contracts and last, restores again. However, since the pulse widths w1 of the first and second auxiliary pulses SP1 and SP2 are sufficiently short compared with the pulse width (section D) of the expansion pulse EP and the pulse width (section P) of the contraction pulse CP, the ink drop is not ejected from the nozzle 8. In other words, the pulse widths w1 of the first and second auxiliary pulses SP1 and SP2 are set to widths in such a degree as not to eject the ink drop from the nozzle 8. Before an action effect caused by applying the auxiliary pulse signal is described, a single-nozzle driving state, a multi-nozzle simultaneous driving state and a continuous multi-nozzle driving state are described further.

In the head 100 according to the present embodiment, the adjacent channels share the partition walls of the pressure chambers 15, and three columns of the nozzles 8 are arranged zigzag. The division driving is carried out in such a manner that the pressure chambers 15 are divided into three groups every third pressure chamber, that is, three division driving is carried out. The single-nozzle driving state refers to a state where the ink is ejected only from one nozzle 8. In the single-nozzle driving state, the number of the channels for ejecting the ink is only one. Thus, pressure generated in the pressure chamber 15 of the channel for ejecting the ink is propagated to the surrounding channels, and a slightly complex behavior in the spatial direction is indicated as the behavior of the pressure chamber 15. The multi-nozzle simultaneous driving state refers to a state where the ink is ejected from the nozzles belonging to one group and the ink is not ejected from the nozzles belonging to other groups. In the multi-nozzle simultaneous driving state, since the ink is simultaneously ejected from a plurality of channels arranged at a given interval in the arrangement direction of the nozzles 8, the behaviors of all the pressure chambers 15 are uniform. Thus, the simplest behavior is set to the behavior of the pressure chamber 15.

The continuous multi-nozzle driving state refers to a state where the ink is ejected from the nozzles belonging to at least two groups at time division. In the continuous multi-nozzle driving state, when the ink is ejected from the adjacent channels, hysteresis for driving the actuator of a signal partition wall is left in the channel sharing the actuator with the adjacent channel. The hysteresis brings about an influence on the operation of the actuator of the channel and indicates the complex behavior in the time direction as the behavior of the pressure chamber 15. According to the foregoing reason, an ejection speed of an ink drop is evaluated in a case of ejecting only one drop from the same nozzle and in a case of continuously ejecting two drops or more respectively in three modes including the single-nozzle driving state, the multi-nozzle simultaneous driving state and the continuous multi-nozzle driving state.

By the way, a gray scale printing method for adjusting the size of a dot diameter on a printing medium through the ejection number of the ink drops continuously ejected from the nozzle is called the multi-drop method. In the multi-drop method, in order to obtain a stable ejection state, it is desired that the change of the ejection speed depending on the number of the continuous ink drops is small.

Figure 9:
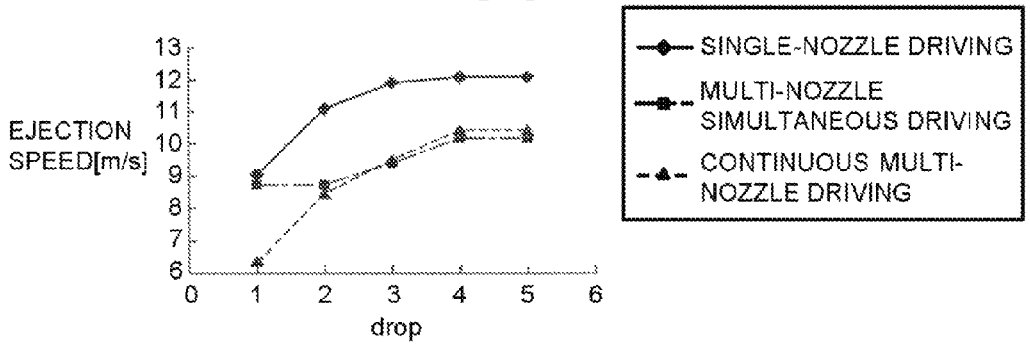
FIG. 9 is a graph illustrating an example of an ejection speed of each drop when an auxiliary pulse waveform is not applied.
Figure 10:
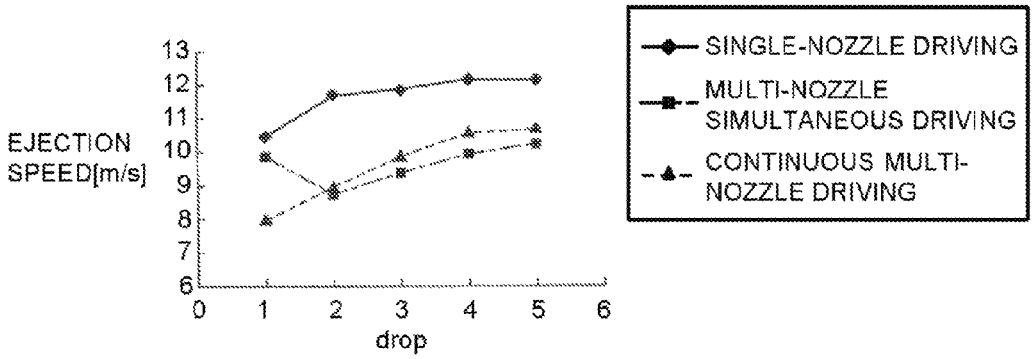
FIG. 10 is a graph illustrating an example of the ejection speed of each drop when only first auxiliary pulse is applied.
Figure 11:
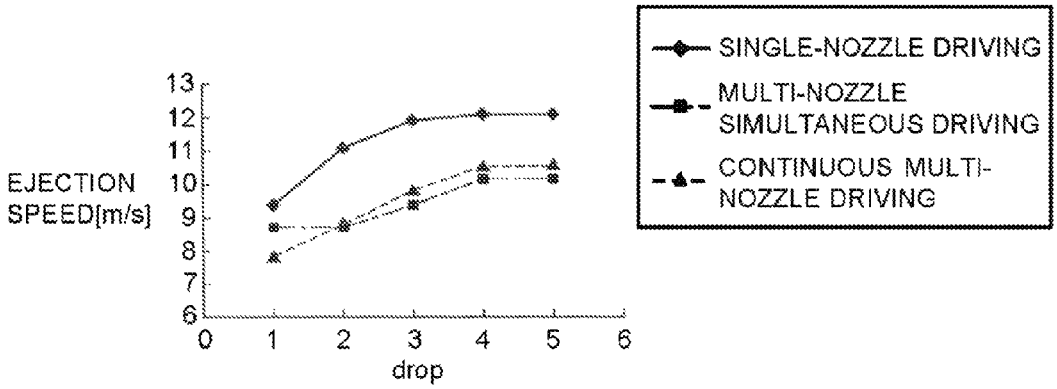
FIG. 11 is a graph illustrating an example of the ejection speed of each drop when both the first auxiliary pulse and a second auxiliary pulse are applied.

Next, the action effect caused by applying the auxiliary pulse signal is described with reference to FIG. 9~FIG. 11. FIG. 9~FIG. 11 illustrates examples of the ejection speed (m/s) when only one drop or 2~5 drops are continuously ejected with the multi-drop method in each state of the single-nozzle driving state, the multi-nozzle simultaneous driving state and the continuous multi-nozzle driving state. In FIG. 9~FIG. 11, the numerical value of the vertical axis of the plotted point corresponding to the numerical value "1" of the horizontal axis is the ejection speed when only one drop is ejected. The numerical value of the vertical axis of the plotted point corresponding to the numerical value "2" of the horizontal axis is the ejection speed of the second drop when two drops are continuously ejected. The numerical value of the vertical axis of the plotted point corresponding to the numerical value "3" of the horizontal axis is the ejection speed of the third drop when three drops are continuously ejected. The numerical value of the vertical axis of the plotted point corresponding to the numerical value "4" of the horizontal axis is the ejection speed of the fourth drop when four drops are continuously ejected. The numerical value of the vertical axis of the plotted point corresponding to the numerical value "5" of the horizontal axis is the ejection speed of the fifth drop when five drops are continuously ejected. FIG. 9 is a graph when the auxiliary pulse waveform is not applied, FIG. 10 is a graph when only the first auxiliary pulse SP1 is applied and FIG. 11 is a graph when the first auxiliary pulse SP1 and the second auxiliary pulse SP2 are applied. In each figure, the graph indicated by the solid line indicates the ejection speed (m/s) in the single-nozzle driving state. The graph indicated by the dashed line indicates the ejection speed (m/s) in the multi-nozzle simultaneous driving state. The graph indicated by the broken line indicates the ejection speed (m/s) in the continuous multi-nozzle driving state.

In a case in which the auxiliary pulse waveform is not applied, as shown in FIG. 9, in the single-nozzle driving state and the continuous multi-nozzle driving state, the ejection speed when only one drop is ejected is slower than that of the final drop when two drops or more are continuously ejected. Specifically, in the continuous multi-nozzle driving state, the ejection speed when only one drop is ejected is extremely slow, and thus the stable printing quality is not obtained.

In a case in which only the first auxiliary pulse SP1 is applied as the auxiliary pulse waveform, as shown in FIG. 10, in the single-nozzle driving state and the continuous multi-nozzle driving state, the ejection speed when only one drop is ejected is fast, and thus the change of the ejection speed depending on the number of the continuously ejected drops can be suppressed. Even in the multi-nozzle simultaneous driving state, the ejection speed when only one drop is ejected is fast due to the first auxiliary pulse SP1, but in the multi-nozzle simultaneous driving state, the first auxiliary pulse SP1 does not necessarily suppress the change of the ejection speed. In the multi-nozzle simultaneous driving state, even if the drive waveform with no auxiliary pulse signal is applied, as shown in FIG. 9, there is not much difference originally between the ejection speed when only one drop is ejected and the ejection speed of the second drop when two drops are continuously ejected. Thus, if the first auxiliary pulse SP1 is applied, the ejection speed of the second drop is slower than that of the first drop relatively; on the contrary, the speed balance is collapsed. If two drops are continuously ejected in this state, the second drop which is slow separately reaches to the printing medium from the first drop, and thus there is a high possibility that the printing quality is reduced.

In a case in which the first auxiliary pulse SP1 and the second auxiliary pulse SP2 are applied as the auxiliary pulse waveforms, as shown in FIG. 11, in the single-nozzle driving state and the continuous multi-nozzle driving state, the ejection speed when only one drop is ejected is fast. However, in the multi-nozzle simultaneous driving state, the ejection speed when only one drop is ejected is not too fast, and is identical to that of the second drop when two drops are continuously ejected continuously. Thus, as the speed balance is not collapsed, the second drop does not separately reach to the printing medium from the first drop.

In this way, in the present embodiment, the second auxiliary pulse SP2 of the reverse polarity to the first auxiliary pulse SP1 is applied before the first auxiliary pulse SP1 which achieves the same function as the conventional boost pulse as the auxiliary pulse signal. In this case, the ejection speed of the multiple drops can be stabilized not only in the single-nozzle driving state and the continuous multi-nozzle driving state but also in the multi-nozzle simultaneous driving state; in addition, the inkjet head capable of carrying out the high-quality printing and the inkjet printer using the inkjet head can be provided.

The pulse widths w1 of the first and second auxiliary pulses SP1 and SP2 are verified with reference to FIG. 12~FIG. 16. The pulse width w1 of the first auxiliary pulse SP1 is identical to that of the second auxiliary pulse SP2. Further, the pulse center distance between the first auxiliary pulse SP1 and the second auxiliary pulse SP2 is equal to the resonance period 2AL of the pressure chamber with the ink.

Figure 12:
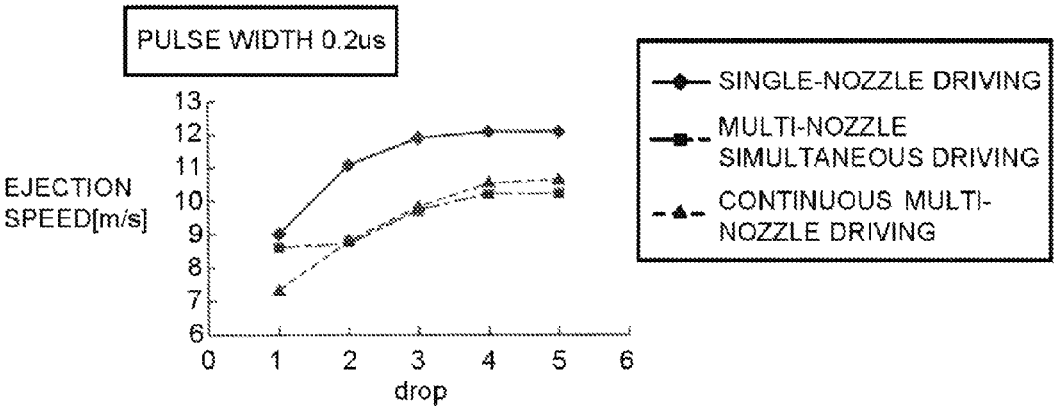
FIG. 12 is a graph illustrating an example of the ejection speed of each drop when a pulse width of the first auxiliary pulse and the second auxiliary pulse is set to 0.2 μs.
Figure 13:
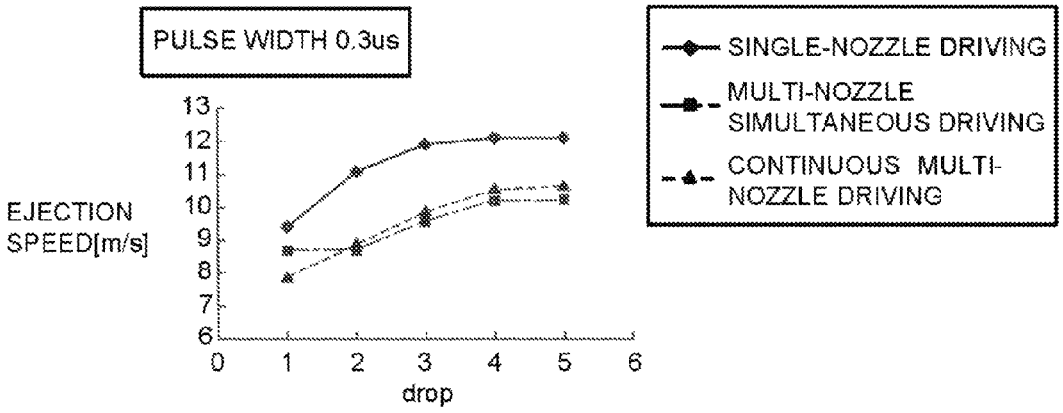
FIG. 13 is a graph illustrating an example of the ejection speed of each drop when the pulse width of the first auxiliary pulse and the second auxiliary pulse is set to be 0.3 μs.
Figure 14:
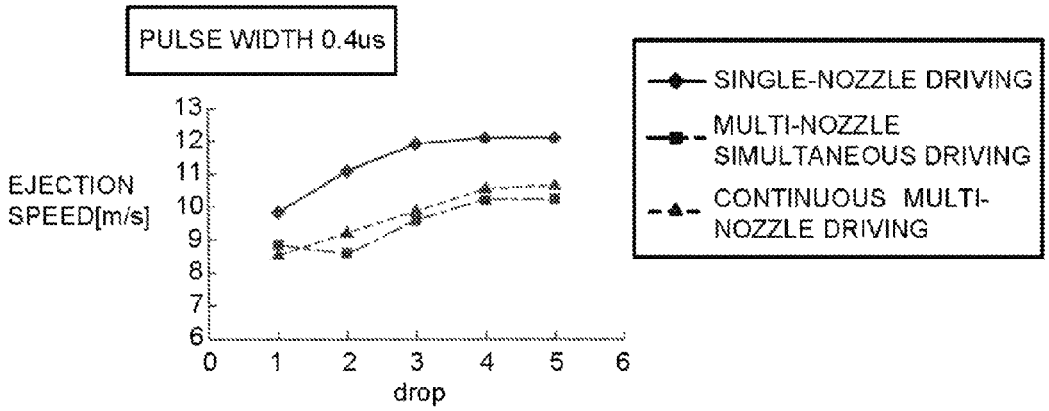
FIG. 14 is a graph illustrating an example of the ejection speed of each drop when the pulse width of the first auxiliary pulse and the second auxiliary pulse is set to 0.4 μs.
Figure 15:
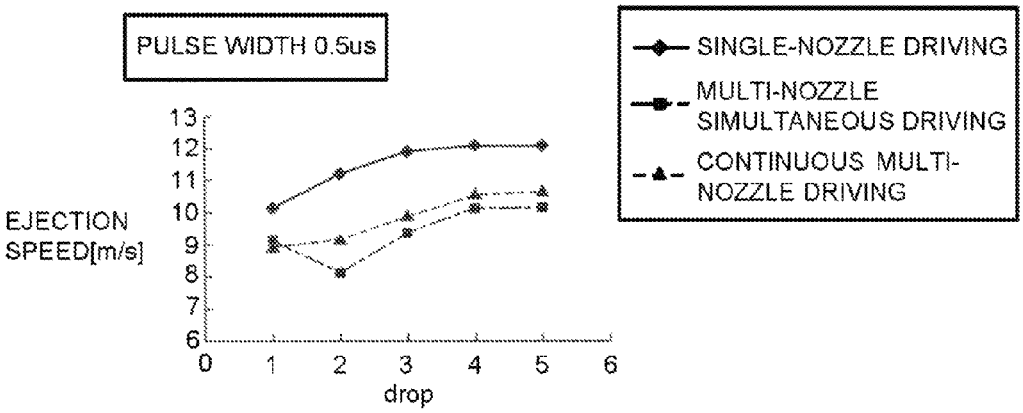
FIG. 15 is a graph illustrating an example of the ejection speed of each drop when the pulse width of the first auxiliary pulse and the second auxiliary pulse is set to 0.5 μs.
Figure 16:
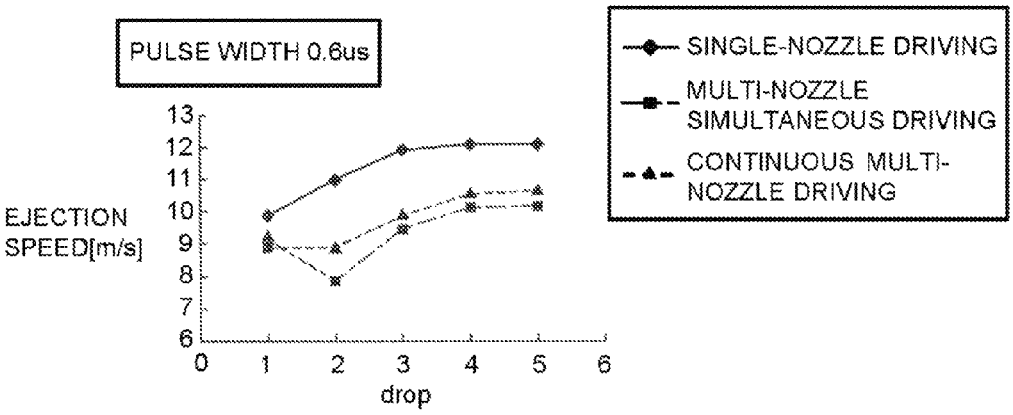
FIG. 16 is a graph illustrating an example of the ejection speed of each drop when the pulse width of the first auxiliary pulse and the second auxiliary pulse is set to 0.6 μs.

FIG. 12~FIG. 16 each illustrate an example of the ejection speed (m/s) of each drop in each state of the single-nozzle driving state, the multi-nozzle simultaneous driving state and the continuous multi-nozzle driving state when five drops are continuously ejected through the multi-drop method. FIG. 12 is a graph when the pulse width w1 is 0.2 μs. FIG. 13 is a graph when the pulse width w1 is 0.3 μs. FIG. 14 is a graph when the pulse width w1 is 0.4 μs. FIG. 15 is a graph when the pulse width w1 is 0.5 μs. FIG. 16 is a graph when the pulse width w1 is 0.6 μs. In each figure, the solid line indicates the ejection speed (m/s) in the single-nozzle driving state. The dashed line indicates the ejection speed (m/s) in the multi-nozzle simultaneous driving state. The broken line indicates the ejection speed (m/s) in the continuous multi-nozzle driving state.

When the pulse width is 0.2 μs, as shown in FIG. 12, in each state of the single-nozzle driving state, the multi-nozzle simultaneous driving state and the continuous multi-nozzle driving state, the ejection speed of the first drop in the continuous multi-nozzle driving state is slow and dispersion occurs. Furthermore, in the continuous multi-nozzle driving state, as the ejection speed of the first drop is still slower than that of the second drop, the ejection is instable.

If the pulse width is 0.3 μs, as shown in FIG. 13, even in the continuous multi-nozzle driving state, the ejection speed of the first drop becomes fast, and a too big difference is not generated compared with the second drop. In each state of the single-nozzle driving state, the multi-nozzle simultaneous driving state and the continuous multi-nozzle driving state, the ejection speeds of the first drop are almost identical to one another. Thus, the stable ejection effect is obtained in any one state.

If the pulse width is 0.4 μs, as shown in FIG. 14, in each state of the single-nozzle driving state, the multi-nozzle simultaneous driving state and the continuous multi-nozzle driving state, the ejection speeds of the first drop are almost identical to one another. Further, compared with the second drop, the ejection speed of the first drop is not too slow. Instead, as the ejection speed of the first drop is slightly faster than that of the second drop in the multi-nozzle simultaneous driving state, the speed balance is yet acceptable.

If the pulse width is 0.5 μs, as shown in FIG. 15, in the multi-nozzle simultaneous driving state, as the ejection speed of the first drop is faster than that of the second drop, the speed balance is collapsed. This point is also obvious in a case in which the pulse width is 0.6 μs as shown in FIG. 16.

Thus, in the case of the examples illustrated in FIG. 12~FIG. 16, in the range from 0.3 μs to 0.4 μs, the pulse widths w1 of the first and second auxiliary pulses can bring about an effect for stabilizing the ejection speeds of the multiple drops regardless of the driving state.

Next, a principle of generating the effect according to the present embodiment is described. As stated in the background art, that the auxiliary pulse signal, that is, the boost pulse in such a degree as not to eject the ink drop is applied before the ejection of the ink drop to realize homogenization of the ejection speed is already carried out. By applying the boost pulse, there is an effect for compensating a difference between a case in which the pressure vibration is applied in a state where the meniscus is still and a case in which the pressure vibration is applied in a state where residual pressure vibration of the ink drop just ejected is left. However, the effect obtained by using the second auxiliary pulse SP2 and the first auxiliary pulse SP1 together cannot be explained only through the reason of compensating the difference of the residual pressure vibration. In order to understand the effect of the second auxiliary pulse SP2, it is necessary to previously understand hysteresis caused by hysteresis of the actuator. Thus, firstly, the difference between operations in the single-nozzle driving state and the multi-nozzle simultaneous driving state and that in the continuous multi-nozzle driving state is described through the operations of the actuators by a simple drive waveform with no auxiliary pulse, in other words, the DRP waveform shown in the section T1 of FIG. 8.

In the single-nozzle driving state and the multi-nozzle simultaneous driving state, no ink is ejected from adjacent channels between a dot (a collection of multiple drops) and a next dot. Thus, the operations of the actuators are repeated in order of (a)→(b)→(a)→(c)→(a)→(b)→(a)→(c) in FIG. 4B. In the repetition, two ink drops are ejected from the nozzle 8 communicating with the central pressure chamber 15*b*. At that time, the actuators arranged corresponding to the pressure chamber 15*b* certainly carry out a contraction operation through the contraction pulse CP before expanding through the expansion pulse EP.

Figure 17:
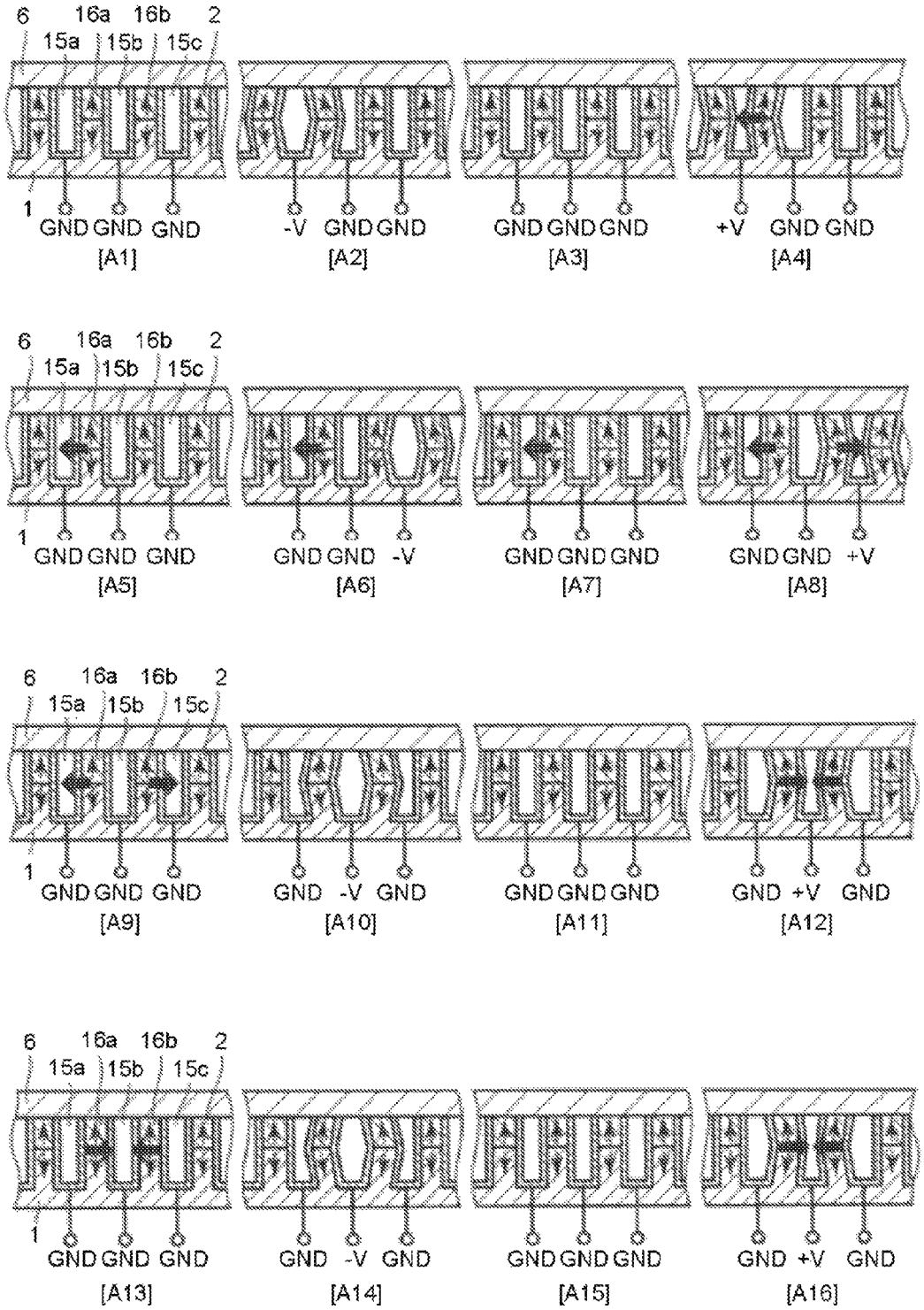
FIG. 17 is a diagram illustrating an operation principle of an actuator in a continuous multi-nozzle driving state.

On the contrary, in the continuous multi-nozzle driving state, it is necessary to consider the movement of the adjacent pressure chambers 15. FIG. 17 illustrates the operations of the actuators corresponding to the pressure chambers 15*a*, 15*b* and 15*c* in a case in which the ink drop is firstly ejected from the nozzle 8 communicating with the left pressure chamber 15*a* and then the ink drop is ejected from the nozzle 8 communicating with the right pressure chamber 15*c* before the ink drop is ejected from the nozzle 8 communicating with the central pressure chamber 15*b*.

A1~A4 indicate the operations of the actuators at the time the ink drop is ejected from the nozzle 8 communicating with the left pressure chamber 15*a*, and in a case in which the ink drops are continuously ejected for multiple droplet per dot, the operations in A1~A4 are repeated. A5~A8 indicate the operations of the actuators at the time the ink drop is ejected from the nozzle 8 communicating with the right pressure chamber 15*c*, and in a case in which the ink drops are continuously ejected for multiple droplet per dot, the operations in A5~A8 are repeated. A9~A16 indicate the operations of the actuators at the time the ink drop is ejected from the nozzle 8 communicating with the central pressure chamber 15*b*, A9~A12 indicate the operations of the first drop, and A13~A16 indicate the operations of the second drop. In a case in which the ink drop following the third drop is ejected, the operations in A13~A16 are repeated.

The partition wall 16*a* serving as one actuator for applying the pressure vibration to the inside of the pressure chamber 15*b* holds the hysteresis in the left direction in FIG. 17 in the operation of A4. Then, the hysteresis is kept until the operation of A9. On the contrary, the partition wall 16*b* serving as the other actuator holds the hysteresis in the right direction in FIG. 17 in the operation of A8. Then, the hysteresis is kept until the operation of A9. Thus, when the partition walls 16*a* and 16*b* are deformed in the expanding directions in the operation of A10, the directions of the deformation are respectively identical to those of the hysteresis.

However, in a case in which the ink drop following the second drop is ejected from the nozzle 8 communicating with the central pressure chamber 15*b*, the state is changed. One partition wall 16*a* holds the hysteresis in the right direction in FIG. 17 in the operation of A12. Then, the hysteresis is kept until the operation of A13. The other partition wall 16*b* holds the hysteresis in the left direction in FIG. 17 in the operation of A12. Then, the hysteresis is kept until the operation of A13. Thus, when the partition walls 16*a* and 16*b* are deformed in the expanding directions in the operation of A14, the directions of the deformation are respectively reverse to those of the hysteresis.

In this way, in the continuous multi-nozzle driving state, the directions of the hysteresis when the actuator is operated are different in the first drop and the second drop and the later. The difference in the directions is a reason why the ejection speed of the first drop is greatly reduced. In order to understand the reason, next, hysteresis characteristics of the PZT (lead zirconate titanate) used as piezoelectric materials 1 and 2 are described.

Figure 18:
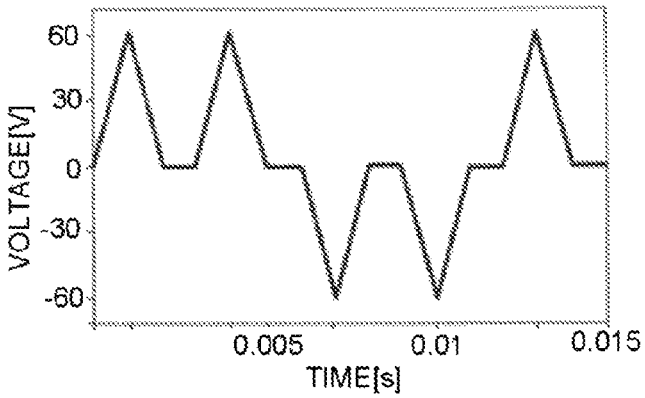
FIG. 18 is a diagram illustrating a voltage waveform applied to a PZT test piece.

The hysteresis characteristics are described with the use of a test piece of the PZT. The test piece is a rectangular parallelepiped with the height 10 (mm), the width 3 (mm) and the thickness 0.2 (mm). The test piece is polarized in the height direction, and a voltage of a waveform shown in FIG. 18 is applied in the thickness direction. Since the thickness of the test piece is about 2.3 times as much as that of the partition wall of the head 100, the voltage is 60(V).

Figure 19:
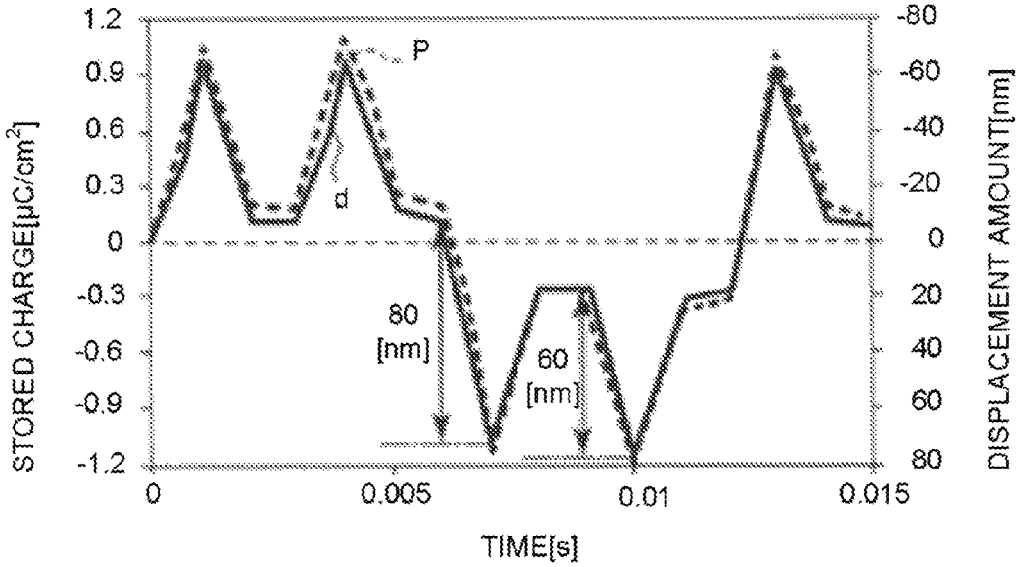
FIG. 19 is a diagram illustrating a stored charge and a displacement amount of the PZT test piece when applying the voltage waveform in FIG. 18 to the PZT test piece.

If the voltage of the waveform shown in FIG. 18 is applied to measure a stored charge P1 ($\mu C/cm^2$) injected into the test piece and a displacement amount d(nm) of the test piece, a result shown in FIG. 19 is obtained. In other words, in a case in which the actuator holds the hysteresis in the same direction, there is a displacement of 60 (nm) in the test piece in the voltage change of 60(V). On the contrary, in a case in which the actuator holds the hysteresis in the reverse direction, there is a displacement of 80 (nm) in the test piece in the voltage change of 60(V). In other words, by holding the hysteresis in the reverse direction, the displacement is increased to a displacement of 133% with respect to that at the time of holding the hysteresis in the same direction. In this way, the displacement amount of the test piece at the time of holding the hysteresis in the same direction is smaller than that at the time of holding the hysteresis in the reverse direction. Thus, it is considered that the ejection speed of the first drop in the continuous multi-nozzle driving state where the hysteresis in the same direction is held is greatly reduced.

Figure 20:
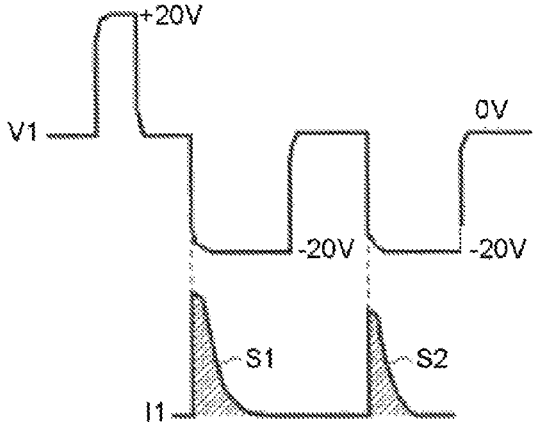
FIG. 20 is a diagram illustrating a relation between a voltage applied to the inkjet head and a charging current of the actuator.

Incidentally, as shown in FIG. 19, the profile of the displacement is similar to that of the stored charge. On the other hand, it is difficult to measure the displacement of the actuator in a state of being assembled in the head 100, but the stored charge can be easily calculated from a current waveform. Next, the stored charge is used to investigate the hysteresis characteristic of the actuator assembled in the head 100. Specifically, a voltage indicated by a waveform V1 in FIG. 20 is applied to the head 100, and a charging current of the actuator is measured. The capacitance of the actuator is about 400 (pF) through the parallel of the partition wall 16*a* and the partition wall 16*b*.

The charging current is measured as a waveform I1 in FIG. 20. An area S1 of the waveform I1 represents the stored charge at the time of the hysteresis is held in the reverse direction, and an area S2 thereof represents the stored charge at the time of the hysteresis is held in the same direction. Thus, if the stored charge P is measured according to the area S1 or S2, the stored charge measured according to the area S1 is 4.2 (nC), and the stored charge measured according to the area S2 is 3.1 (nC).

In other words, even in a state of being assembled in the head 100, the charge of 133% is injected at the time the actuator holds the hysteresis in the reverse direction with respect to the time the actuator holds the hysteresis in the same direction.

From the foregoing result, as the displacement of the actuator at the time of holding the hysteresis in the same direction is smaller than that at the time of holding the hysteresis in the reverse direction, it is known that the ejection speed of the first drop in the continuous multi-nozzle driving state where the hysteresis in the same direction is held is greatly reduced.

In this way, in the present embodiment, it can be said that the PZT used as the piezoelectric members 1 and 2 holds the hysteresis of about 33% under the test condition. The size of the hysteresis of the piezoelectric members 1 and 2 directly acts on the size of the displacement of the actuator. The size of the actuator displacement of the actuator brings about the influence on the ejection speed and an ejection amount of the ink drop. Thus, the hysteresis with the size exceeding 30% cannot be ignored with respect to the printing quality. Thus, in the case of using the piezoelectric member holding the hysteresis with the size exceeding 30%, the hysteresis may be considered and preferably controlled to always hold the hysteresis in the reverse direction. By always holding the hysteresis in the reverse direction, the ejection speed and the ejection amount of the ink drop are stabilized, and high-efficiency and high-quality print results can be obtained. For example, the piezoelectric member made from a soft material of which the mechanical quality factor Qm is small and the piezoelectric strain constant (d is constant) is large generally holds the large hysteresis. By suitably using the hysteresis as stated above rather than trying to avoid using the piezoelectric member holding the large hysteresis, the displacement of the actuator can be large and the stable displacement can be obtained.

Through the foregoing description, in the continuous multi-nozzle driving state, the effects caused by using the second auxiliary pulse SP2 and the first auxiliary pulse SP1 together are described as follows.

Firstly, by applying the first auxiliary pulse SP1 to the head 100, before the first drop is ejected, as the hysteresis in the reverse direction is applied to the actuator, the effect of amplitude expansion of the actuator using the hysteresis and the effect of the residual pressure vibration caused by applying the prior vibration to liquid are achieved. However, the effect caused by applying the hysteresis in the reverse direction to the actuator just acts on the first drop rather than the second drop and the later. On the other hand, by applying the residual pressure vibration, the pressure vibration at the time of the end of the first drop changes. Thus, as described with reference to FIG. 10, the speed of the second drop is reduced only in the case of only applying the first auxiliary pulse SP1.

Thus, before the first auxiliary pulse SP1, the second auxiliary pulse SP2 is applied to the head 100. The second auxiliary pulse SP2 applies amplitude of an opposite phase before one period of the first auxiliary pulse SP1. Thus, by applying the second auxiliary pulse SP2, the prior vibration applied to the liquid through the first auxiliary pulse SP1 is decreased. However, as the hysteresis of the actuator is determined in the direction of the last pulse, even if the second auxiliary pulse SP2 is applied, the hysteresis does not change. As a result, as described with reference to FIG. 11, by using the first auxiliary pulse SP1 and the second auxiliary pulse SP2 together, the reduction in the ejection speed of the second drop when two drops are continuously ejected can be improved.

In this way of thinking, as described with reference to FIG. 12 to FIG. 16, by adjusting the pulse widths of the first auxiliary pulse SP1 and the second auxiliary pulse SP2, it is possible to suppress the reduction in the ejection speed of the second drop and the ejection speed of the first drop is increased.

In the present embodiment, the pulse width of the first auxiliary pulse SP1 is identical to that of the second auxiliary pulse SP2, but it is also possible to finely adjust balances of two effects by varying the pulse width of the first auxiliary pulse SP1 from that of the second auxiliary pulse SP2. As the simplest example, a determination method of the waveforms of the auxiliary pulses SP1 and SP2 in a case of only cancelling the hysteresis without applying the prior vibration to the liquid is described. Once the auxiliary pulses SP1 and SP2 are temporarily determined through the method, after the influence of the hysteresis is cancelled, the first auxiliary pulse SP1 is further adjusted and the prior vibration can be applied to the liquid. In the description, the equivalent circuit for simulating the pressure chamber is used.

Figure 21:
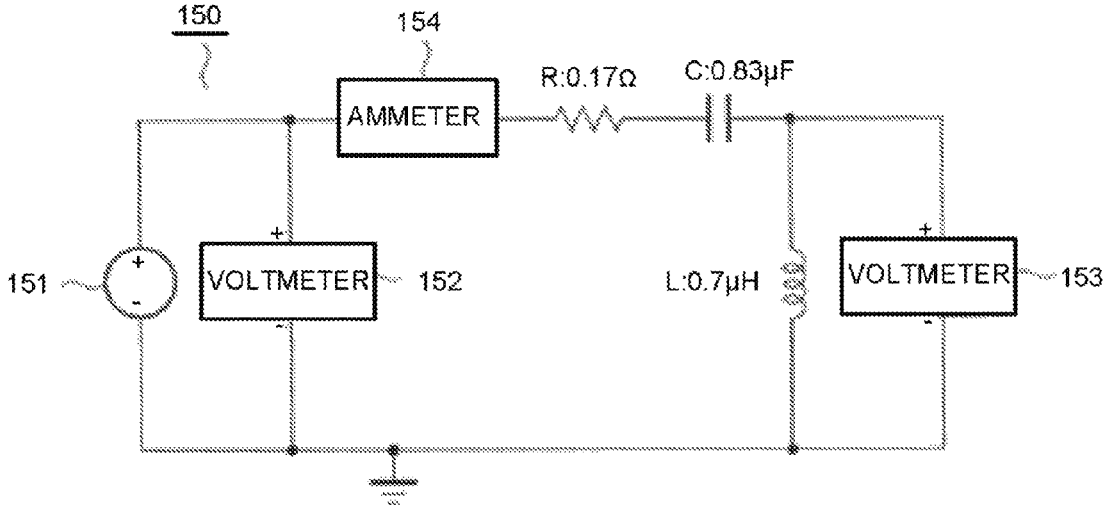
FIG. 21 is a diagram illustrating an equivalent circuit of a pressure chamber.

FIG. 21 illustrates an equivalent circuit 150 for simulating the pressure chamber. The equivalent circuit 150 connects one end of a resistance R (0.17Ω) to a positive voltage terminal of a voltage source 151, connects one end of a capacitor C (0.83 μF) to the other end of the resistance R, connects one end of an inductor L (0.7 μH) to the other end of the capacitor C and connects the other end of the inductor L to the negative voltage terminal of the voltage source 151. A voltage of the voltage source 151 is measured by a first voltmeter 152, a both-end voltage of the inductor L is measured by a second voltmeter 153 and a circuit current is measured by an ammeter 154. The voltage of the voltage source 151 is equivalent to a drive voltage. The both-end voltage of the inductor L is equivalent to pressure of ink nearby a nozzle. The circuit current is equivalent to velocity of flow of the ink nearby the nozzle. However, each numerical value of the drive voltage, the pressure of the ink and the velocity of flow of the ink is normalized to 1.

Figure 22:
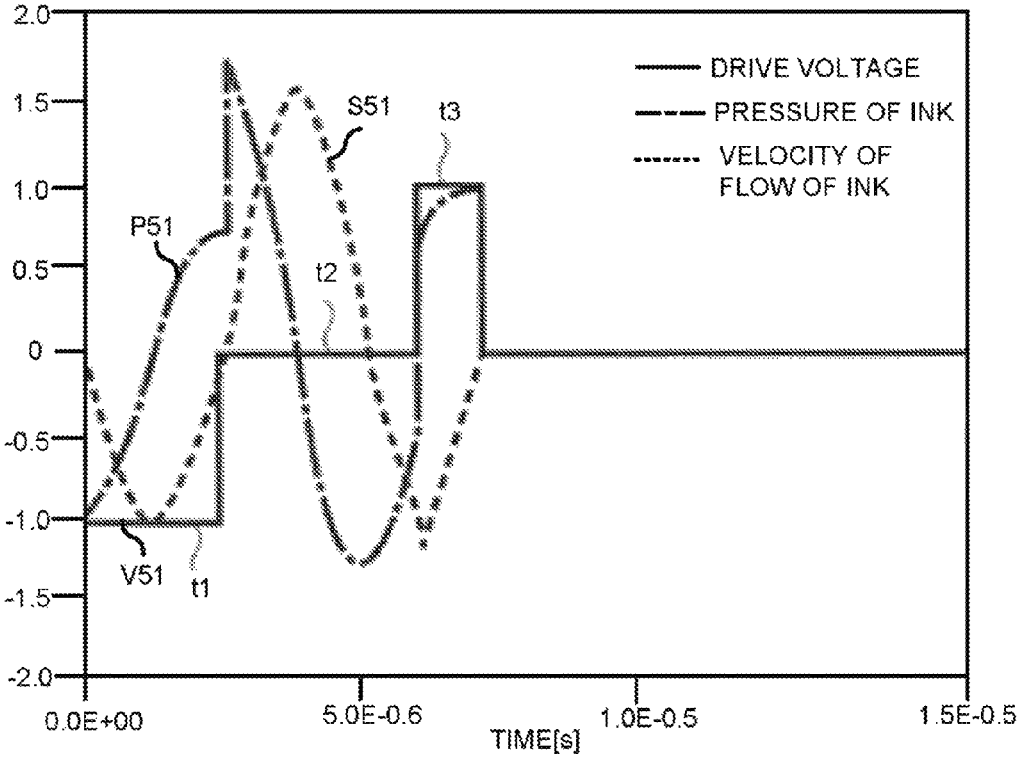
FIG. 22 is a graph illustrating a result of simulation after the equivalent circuit in FIG. 21 is carried out.

If the simulation is carried out by using the drive circuit, as shown in FIG. 22, the driving voltage waveform can be adjusted in order not to leave the pressure vibration after the ink is ejected. In FIG. 22, a waveform V51 indicates the drive voltage, a waveform P51 indicates the pressure of the ink, and a waveform S51 indicates the velocity of flow of the ink. In the driving voltage waveform V51, a period t1 of the negative potential is 2.4 (μs), a period t2 of the ground potential is 3.25 (μs), and a period t3 of the positive potential is 0.9 (μs). The period of the pressure vibration of the pressure chamber included in the head 100 is 4.8 (μs), and thus the period t1 of the negative potential is set to the most efficient condition, that is, ½ of period of the pressure vibration. By the way, the reason why the period t2 of the ground potential and the period t3 of the positive potential are different from the period t1 of the negative potential is caused by the loss of the pressure chamber, that is, the resistance R.

Figure 23:
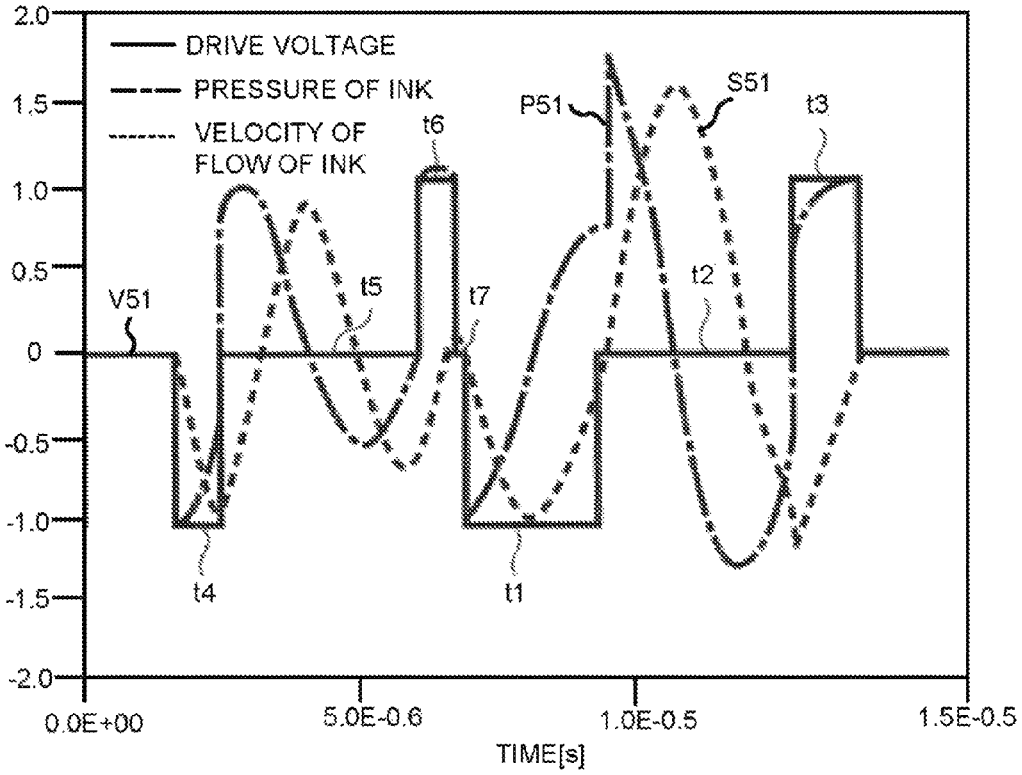
FIG. 23 is a graph illustrating a result of the simulation after the equivalent circuit in FIG. 21 is carried out.

Next, the simulation is carried out in a case in which the first auxiliary pulse SP1 and the second auxiliary pulse SP2 are input before the drive voltage. As shown in FIG. 23, firstly, the second auxiliary pulse SP2 of the negative potential is only input at a section t4=0.8 (μs). The section t4 is an arbitrary short value in such a degree as not to eject the ink. However, if the section T4 is too short, a section t6 of the first auxiliary pulse SP1 input next becomes so small that the actuator does not respond, the value of the section t4 is desired to be about 0.8 (μs). Next, in order to disappear the residual vibration of a section t7 of the ground potential after the first auxiliary pulse SP1 is applied with the use of the simulation, a section t5 of the ground potential and the section t6 of the first auxiliary pulse SP1 of the positive potential are adjusted. If there is no residual vibration of the section t7, the waveforms of the pressure of the ink and the velocity of flow generated through the continuous driving voltage waveform should be coincident with those in a case in which there are no auxiliary pulses SP1 and SP2. In the case of FIG. 23, there are the following equations: section t4=0.8 (μs), section t5=4.25 (μs), section t6=0.45 (μs), section t7=0.2 (μs), section t1=2.4 (μs), section t2=3.25 (μs), and section t3=0.9 (μs).

The sections t1~t7 are adjusted such that the pressure vibration is cancelled at the point in time of the section t7. As the loss (resistance R) of the pressure chamber exist, in a condition where the pressure vibration is cancelled at the point in time of the section t7, there is the following equation "second auxiliary pulse SP2">"first auxiliary pulse SP1". At this time, the interval between the first auxiliary pulse SP1 and the second auxiliary pulse SP2 is slightly longer than the period of the pressure vibration. Then, if the waveform after the auxiliary pulses SP1 and SP2 is observed, the velocity of flow and the pressure of the ink are almost identical to those in a case in which no auxiliary pulses SP1 and SP2 are applied. In the equivalent circuit, the hysteresis is not simulated; however, as the hysteresis always faces a direction in which the pressure chamber is always contracted even at the point in time of the section T7 or at the point in time after the section t3 of the waveform, the influence of the hysteresis is cancelled. Thus, in a case in which the continuous multi-nozzle driving is carried out with the use of the waveform, a problem that the ejection speed of the first drop is extremely reduced as shown in FIG. 9 does not occur. As the waveform does not apply the prior vibration to the liquid, the ejection speeds in the single-nozzle driving state and the multi-nozzle simultaneous driving are the same as those shown in FIG. 9. In other words, the drive waveform improves only the ejection speed of the first drop at the time of the continuous multi-nozzle driving with respect to the characteristics shown in FIG. 9 when the auxiliary pulse are not applied, and is a state in which the first auxiliary pulse SP1 and the second auxiliary pulse SP2 are temporarily determined as a cancellation condition of the hysteresis. It is desired that the most suitable drive waveform further fastens the ejection speed of the first drop a bit. Thus, in order to determine the drive waveform of the head, an ejection observation is carried out by taking the waveform as a reference and the values of the sections t4, t5 and t6 may be finely adjusted. For example, if the first auxiliary pulse SP1 is lengthened on the basis of the state, the prior vibration is applied to the liquid and the ejection speed of the first drop can be fastened.

Incidentally, it is worried that the time needed in the auxiliary pulses SP1 and SP2 reduces the maximum driving frequency at which the head 100 is capable of ejecting the ink drop. The maximum driving frequency is limited by the time needed in a case in which the maximum number of the drops is ejected. Thus, prior to the ejection of the maximum number of the drops, if the auxiliary pulses SP1 and SP2 are applied, the needed time only corresponding to the needed time of the auxiliary pulses becomes longer, and the maximum driving frequency is reduced. However, such a worry can be solved by making the following effort.

In general, in a case in which the number of the ejected drops is large, as the drops flying from behind coalesce with the drops ejected before, there is no problem that the initial drop is slow. The hysteresis of the actuator has no influence on the ejection of the ink of the second drop and the later. Further, even if the hysteresis temporarily has the influence, as shown in FIG. 9 to FIG. 16, normally, the ejection speeds of the ink drops following the third and fourth drops are stable. Thus, in a case in which 3~4 drops or more are continuously ejected, the auxiliary pulses are not necessary.

From these points of view, a control method for controlling to apply the auxiliary pulses only in a case in which only one drop is ejected and not to apply the auxiliary pulses in a case in which two drops or more are continuously ejected can be adopted. In this way, as the ejection speed in a case in which only one drop is ejected is increased and the needed time in a case in which two drops or more are ejected is not increased, the upper limit of the driving frequency is not reduced.

In a case in which the maximum number of the drops is 3 or more, by controlling to apply the auxiliary pulses SP1 and SP2 only in a case in which the drops equal to or smaller than N drops are continuously ejected and not to apply the auxiliary pulses SP1 and SP2 in a case in which N+1 drops or more are continuously ejected, the high speed of the driving frequency can be realized. However, N is equal to or greater than 2 and equal to or smaller than (the maximum number of the drops−1).

Figure 24:
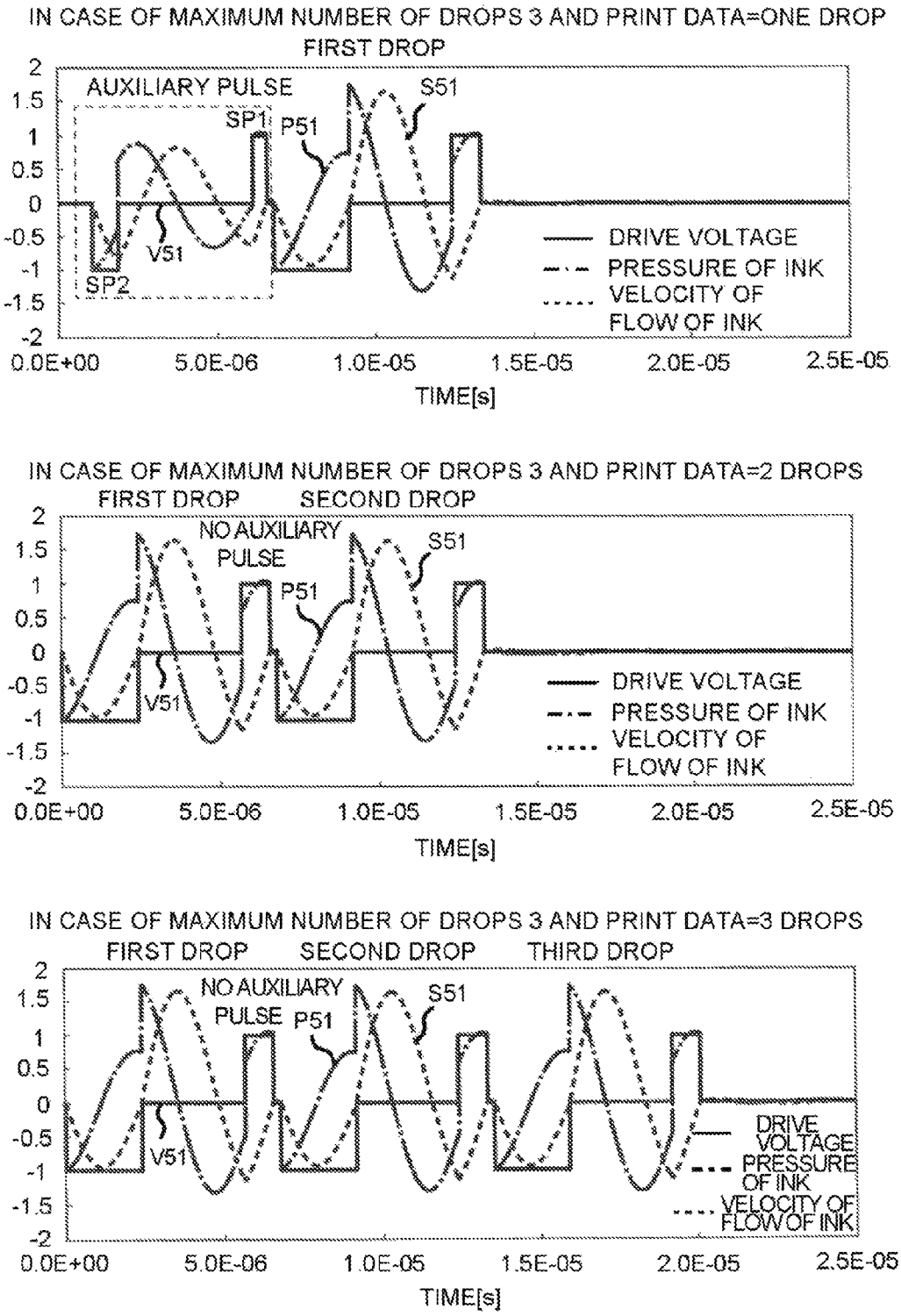
FIG. 24 is a diagram illustrating an example of applying an auxiliary pulse only in a case in which the number of drops is 1 when the maximum number of the drops is 3.
Figure 25:
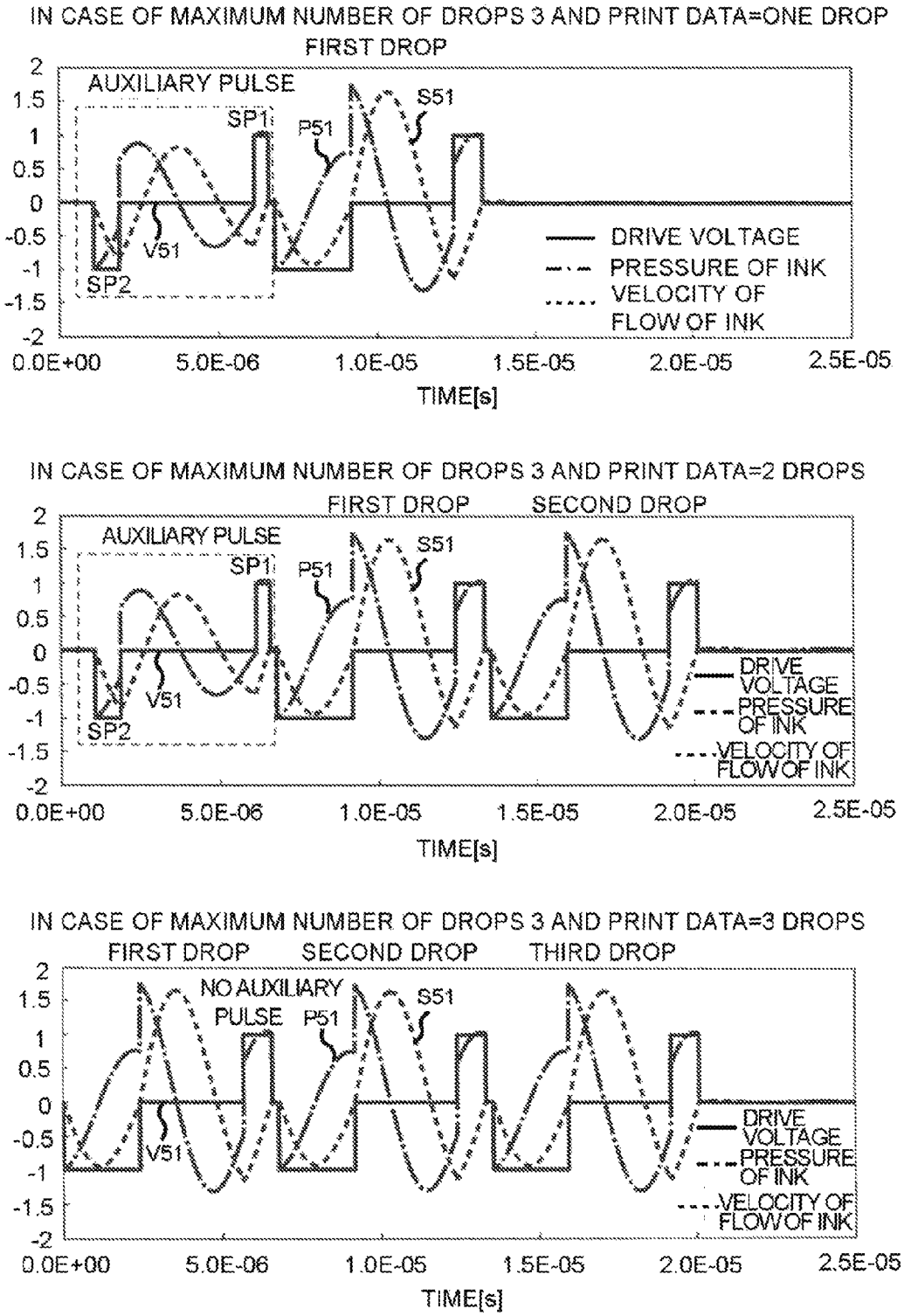
FIG. 25 is a diagram illustrating an example of applying the auxiliary pulse only in a case in which the number of the drops is equal to or smaller than 2 when the maximum number of the drops is 3.

FIG. 24 illustrates an example of applying the auxiliary pulses only in a case in which the number of the drops is 1 when the maximum number of the drops is 3, and FIG. 25 illustrates an example of applying the auxiliary pulses only in a case in which the number of the drops equal to or smaller than 2 when the maximum number of the drops is 3.

A function of determining presence/absence of the auxiliary pulses by determining the number of the drops ejected from now on for each channel according to the print data can be realized in the logic circuit 1012.

Further, in the embodiment, FIG. 12~FIG. 16 each illustrate the ejection speed of each drop in a case in which the pulse widths of the first auxiliary pulse and the second auxiliary pulse are changed, and 0.3~0.4 μs are preferably set as the pulse width; however, the value is only an example after all and is not limited as the preferable value of the present invention. The value may be replaced according to the characteristic of the ink and a proper value may be set for the head 100.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head, comprising:

a pressure chamber configured to house ink;

an actuator configured to be arranged corresponding to the pressure chamber and to generate a different displacement resulting from an applied voltage between a first displacement generated when hysteresis in a last time drive direction is the same as a present drive direction and a second displacement generated when hysteresis in the last time drive direction is reverse to a present drive direction;

a plate configured to have a nozzle communicating with the pressure chamber; and a driving circuit configured to drive the actuator, wherein the driving circuit applies to the actuator a first auxiliary pulse for contracting a volume of the pressure chamber and a second auxiliary pulse for generating an amplitude of pressure vibration of the ink opposite to an amplitude of pressure vibration of the ink resulting from the first auxiliary pulse, wherein the first and second auxiliary pulses do not eject an ink drop from the nozzle, and the second auxiliary pulse is applied prior to the first auxiliary pulse, and then applies to the actuator a drive signal which contains an expansion pulse for expanding the volume of the pressure chamber and a contraction pulse for contracting the volume of the pressure chamber to eject the ink from the pressure chamber once or for multiple times, and wherein the second displacement resulting from the first auxiliary pulse assists to boost an ejection speed of a first ink drop prior to a second ink drop in the multiple ink drops.

2. The inkjet head according to claim 1, wherein the second displacement is larger than the first displacement.

3. The inkjet head according to claim 1, wherein a stored charge on the actuator generating the second displacement is larger than that on the actuator generating the first displacement.

4. The inkjet head according to claim 1, wherein the driving circuit outputs the expansion pulse as a second auxiliary pulse signal.

5. The inkjet head according to claim 1, wherein the driving circuit sets a pulse center interval between the first and second auxiliary pulse signals as a resonance period of the pressure chamber with the ink.

6. The inkjet head according to claim 1, wherein the driving circuit equalizes a pulse width of first and second auxiliary pulse signals.

7. The inkjet head according to claim 1, wherein an auxiliary pulse signal is applied in a case in which a number of the continuous ink drops is equal to or smaller than N (N is equal to or greater than 1 and equal to or smaller than "the maximum number of the drops−1" to form one pixel).

8. An inkjet printer, including:

an inkjet head; and a conveyance mechanism configured to convey an image recording medium to a printing position by the inkjet head, wherein the inkjet head further comprising:

a pressure chamber configured to house ink;

an actuator configured to be arranged corresponding to the pressure chamber and to generate a different displacement resulting from an applied voltage between a first displacement generated when hysteresis in a last time drive direction is the same as a present drive direction and a second displacement generated when hysteresis in the last time drive direction is reverse to a present drive direction;

a plate configured to have a nozzle communicating with the pressure chamber; and a driving circuit configured to drive the actuator, wherein the driving circuit applies to the actuator a first auxiliary pulse for contracting a volume of the pressure chamber and a second auxiliary pulse for generating an amplitude of pressure vibration of the ink opposite to an amplitude of pressure vibration of the ink resulting from the first auxiliary pulse, wherein the first and second auxiliary pulses do not eject an ink drop from the nozzle, and the second auxiliary pulse is applied prior to the first auxiliary pulse, and then applies to the actuator a drive signal which contains an expansion pulse for expanding the volume of the pressure chamber and a contraction pulse for contracting the volume of the pressure chamber to eject the ink from the pressure chamber once or for multiple times, and wherein the second displacement resulting from the first auxiliary pulse assists to boost an ejection speed of a first ink drop prior to a second ink drop in the multiple ink drops.

9. The inkjet printer according to claim 8, wherein the second displacement is larger than the first displacement.

10. The inkjet printer according to claim 8, wherein a stored charge on the actuator generating the second displacement is larger than that on the actuator generating the first displacement.

11. The inkjet printer according to claim 8, wherein the driving circuit outputs the expansion pulse as a second auxiliary pulse signal.

12. The inkjet printer according to claim 8, wherein the driving circuit sets a pulse center interval between first and second auxiliary pulse signals as a resonance period of the pressure chamber with the ink.

13. The inkjet printer according to claim 8, wherein the driving circuit equalizes a pulse width of first and second auxiliary pulse signals.

14. The inkjet printer according to claim 8, wherein an auxiliary pulse signal is applied in a case in which a number of the continuous ink drops is equal to or smaller than N (N is equal to or greater than 1 and equal to or smaller than "the maximum number of the drops−1" to form one pixel).

* * * * *